US010611586B2

(12) United States Patent
Umezawa et al.

(10) Patent No.: US 10,611,586 B2
(45) Date of Patent: Apr. 7, 2020

(54) SHEET STACKING APPARATUS AND IMAGE FORMING APPARATUS

(71) Applicant: CANON KABUSHIKI KAISHA, Tokyo (JP)

(72) Inventors: Masao Umezawa, Mishima (JP); Taisuke Hyodo, Susono (JP); Takashi Kuwata, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/114,677

(22) Filed: Aug. 28, 2018

(65) Prior Publication Data

US 2019/0077619 A1 Mar. 14, 2019

(30) Foreign Application Priority Data

Sep. 11, 2017 (JP) ..... 2017-174342

(51) Int. Cl.
*B65H 1/02* (2006.01)
*B65H 1/04* (2006.01)
(Continued)

(52) U.S. Cl.
CPC ..... *B65H 1/027* (2013.01); *B65H 1/04* (2013.01); *B65H 1/266* (2013.01); *B65H 31/02* (2013.01);
(Continued)

(58) Field of Classification Search
CPC .... B65H 1/027; B65H 1/266; B65H 2405/32; B65H 2405/324; B65H 2405/3521;
(Continued)

(56) References Cited

U.S. PATENT DOCUMENTS 2,687,924 A * 8/1954 Gomersall ..... A47B 88/493 384/19
2,692,802 A * 10/1954 Bienias ..... A47B 88/493 384/19
(Continued)

FOREIGN PATENT DOCUMENTS

JP 2001-173305 A 6/2001
JP 2004-299214 A 10/2004
(Continued)

*Primary Examiner* — David H Bollinger
(74) *Attorney, Agent, or Firm* — Venable LLP

(57) ABSTRACT

A sheet stacking apparatus includes a sheet stacking portion to be mounted into and drawn out of a mounting portion and provided with a side plate including a grip portion by which the sheet stacking portion can be drawn out in the draw-out direction. The sheet stacking portion is supported to be slidable in a draw-out direction by a rail, and the rail is supported to be slidable in the draw-out direction by a rail supporting portion provided in the mounting portion. A rotator is provided on either the rail supporting portion or the rail and disposed in contact with the other of the rail supporting portion and the rail. The rail, the rail supporting portion and the rotator are disposed on one side in the width direction of the sheet stacking portion, and the grip portion is disposed on the other side in the width direction.

19 Claims, 15 Drawing Sheets

(51) Int. Cl.
*B65H 31/02* (2006.01)
*G03G 15/00* (2006.01)
*B65H 1/26* (2006.01)

(52) U.S. Cl.
CPC . *G03G 15/6502* (2013.01); *B65H 2301/4212* (2013.01); *B65H 2402/32* (2013.01); *B65H 2404/152* (2013.01); *B65H 2405/113* (2013.01); *B65H 2405/55* (2013.01); *B65H 2407/20* (2013.01); *B65H 2801/06* (2013.01)

(58) Field of Classification Search
CPC ..... B65H 2405/55; B65H 2402/32; B65H 2402/53; B65H 2402/531; B65H 1/04; B65H 31/22; A47B 88/493; A47B 88/487; A47B 88/437; A47B 2210/0037; A47B 2210/004; A47B 2210/0043; A47B 2210/0008; A47B 2210/0018
USPC ..... 312/334.9, 334.12, 334.18, 334.19, 312/334.21
See application file for complete search history.

(56) References Cited

U.S. PATENT DOCUMENTS

| | | | | |
|---|---|---|---|---|
| 2,859,070 | A * | 11/1958 | Gomersall | A47B 88/493 384/19 |
| 6,527,267 | B1 | 3/2003 | Kuwata et al. | |
| 6,581,922 | B2 | 6/2003 | Kuwata et al. | |
| 6,661,995 | B2 | 12/2003 | Isobe et al. | |
| 9,322,431 | B2 | 4/2016 | Nishioka | |
| 9,440,809 | B2 | 9/2016 | Kuwata et al. | |
| 2009/0057975 | A1* | 3/2009 | Uchida | B65H 1/26 270/1.01 |
| 2014/0021680 | A1* | 1/2014 | Hamasaki | B65H 1/00 271/147 |
| 2014/0217669 | A1* | 8/2014 | Aoji | B65H 31/22 271/297 |

FOREIGN PATENT DOCUMENTS

| | | | |
|---|---|---|---|
| JP | 2008-050081 | A | 3/2008 |
| JP | 2014-046045 | A | 3/2014 |
| JP | 2016-124698 | A | 7/2016 |

* cited by examiner

SHEET STACKING APPARATUS AND IMAGE FORMING APPARATUS

BACKGROUND OF THE INVENTION

Field of the Invention

The present invention relates to a sheet stacking apparatus including a sheet stacking portion on which sheets are stacked and to an image forming apparatus including the sheet stacking apparatus.

Description of the Related Art

In general, an image forming apparatus such as a copier and a printer includes a sheet cassette serving as a sheet stacking portion which is mounted into and drawn out of a mounting portion of an apparatus body. Among image forming apparatuses of this sort, there is known a fixed-type rail fixed to the sheet cassette while a rail guide is fixed to the apparatus body, and the rail is engaged with the rail guide such that the sheet cassette is slidable. If the image forming apparatus needs detachment of the sheet cassette from the apparatus body in replenishing sheets to the sheet cassette, an operation of attaching the sheet cassette again to the apparatus body is required. For this reason, there is a sheet cassette made longer in the mounting/draw-out directions such that the sheet cassette does not drop out of the apparatus body. In that case, however, the apparatus with a long sheet cassette occupies a large space. In order to downsize the apparatus, Japanese Patent Application Laid-open No. 2004-299214 has proposed an image forming apparatus with an extension rail. This document discloses a configuration in which slidable extension rails are provided on fixed rails of a sheet cassette and the extension rails are supported by rail guides provided in an apparatus body. In this configuration, the sheet cassette is drawn out and supported by the extension rails that are also drawn out, without detaching the sheet cassette from the apparatus body.

According to the configuration described in the above-mentioned document, the sheet cassette can be inserted into and drawn out of the apparatus body smoothly without being inclined with respect to the apparatus body, as long as the sheet cassette is applied with operating force equally in left and right. However, a user does not always operate the sheet cassette with laterally equal force. In a case where the user operates the sheet cassette by one hand for example, uneven force may acts on the left and right sides of the sheet cassette. In such a case, sliding amounts of the extension rails with respect to the fixed rails may become different in left and right. When the sliding amounts of the extension rails differ in left and right, the extension rails and the sheet cassette may be inclined, causing such problems that sliding resistance between the rails increases, operating force in operating the sheet cassette inevitably increases and operability of the sheet cassette drops.

SUMMARY OF THE INVENTION

The present disclosure provides a sheet stacking apparatus in which there is operability in mounting and drawing out the sheet stacking portion, and an image forming apparatus including the sheet stacking apparatus.

According to one aspect of the present invention, a sheet stacking apparatus includes: a mounting portion; a sheet stacking portion on which sheets are stacked and which is configured to be mounted into and drawn out of the mounting portion, the sheet stacking portion is provided with a side plate disposed on a downstream side of the sheet stacking portion in a draw-out direction and extending in a width direction orthogonal to the draw-out direction, the side plate including a grip portion by which the sheet stacking portion can be drawn out in the draw-out direction; a rail supporting portion provided in the mounting portion; a rail supported to be slidable in the draw-out direction by the rail supporting portion, wherein the sheet stacking portion is supported by the rail and slidable in the draw-out direction with respect to the rail; and a rotatable rotator provided on either the rail supporting portion or the rail and disposed in contact with the other of the rail supporting portion and the rail, wherein the rail, the rail supporting portion and the rotator are disposed on one side in the width direction with respect to a middle position in the width direction of the sheet stacking portion, and the grip portion is disposed on the other side in the width direction with respect to the middle position.

According to another aspect of the present invention, a sheet stacking apparatus includes: a mounting portion; a sheet stacking portion on which sheets are stacked and which is configured to be mounted into and drawn out of the mounting portion; a rail supporting portion provided in the mounting portion and disposed on one side in a width direction, orthogonal to a draw-out direction of the sheet stacking portion, with respect to a middle position of the sheet stacking portion in the width direction; a rail supported to be slidable in the draw-out direction by the rail supporting portion, wherein the sheet stacking portion is supported by the rail and slidable in the draw-out direction with respect to the rail; and a rotatable rotator provided on either the rail supporting portion or the rail and disposed in contact with the other of the rail supporting portion and the rail, the rotator is configured to rotate such that the rail is urged toward the middle position in the width direction while the rail slides in the draw-out direction.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings.

First Embodiment

Figure 1:
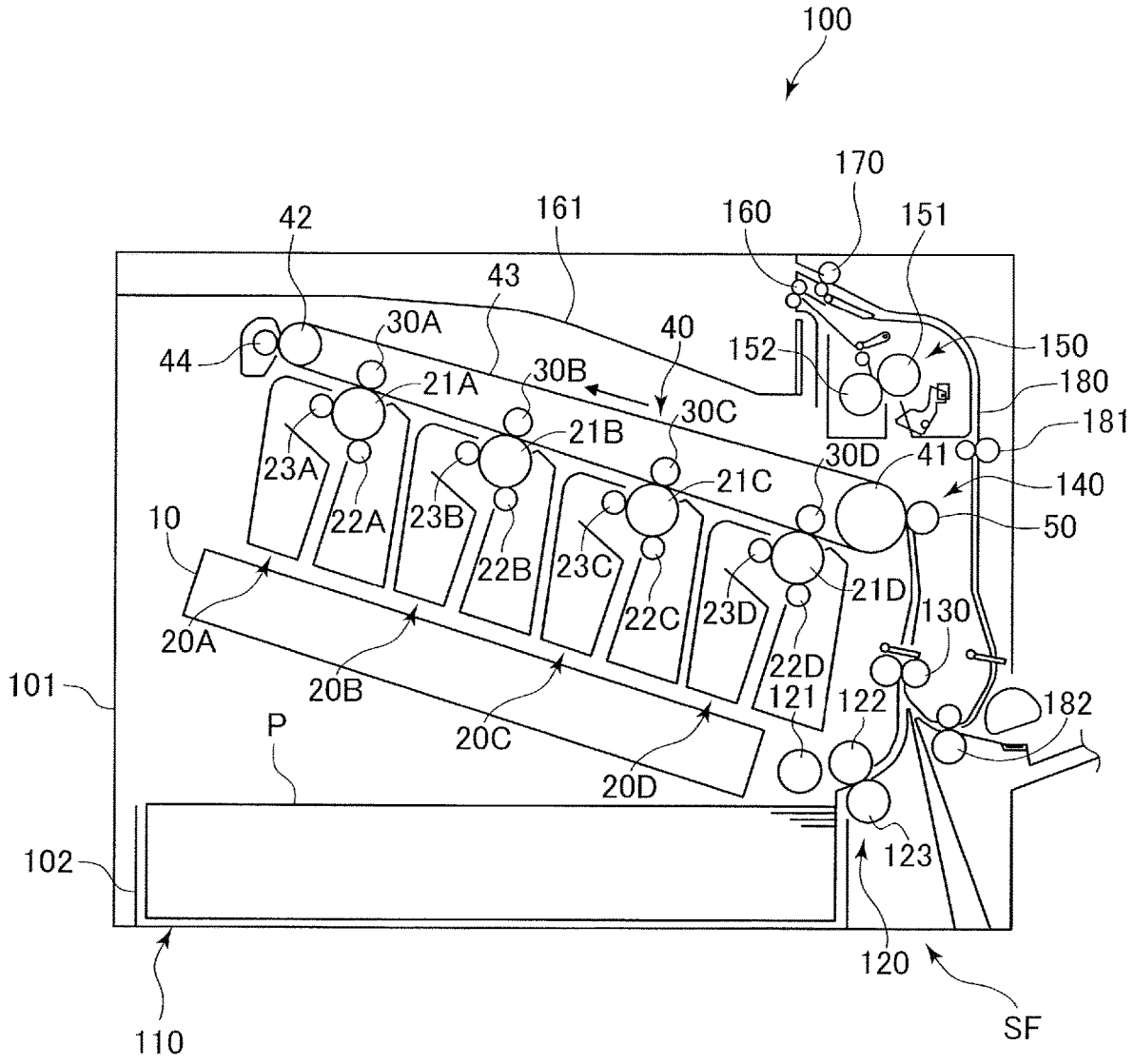
FIG. 1 is a schematic diagram illustrating an image forming apparatus of a first embodiment of the present disclosure.

FIG. 1 is a schematic diagram illustrating an image forming apparatus 100 of the first embodiment. The image forming apparatus 100 is an electrophotographic image forming apparatus such as a copier, a printer, a facsimile machine or a multi-function printer. FIG. 1 illustrates a printer. A sheet P on which an image is to be formed by the image forming apparatus 100 is a recording medium such as a plain sheet of paper, a letter, an envelope or a plastic film for use in an overhead projector (OHP).

The image forming apparatus 100 includes a sheet stacking apparatus 110, a sheet feeding portion 120, a registration roller pair 130, an image forming portion 140, a fixing portion 150 and others. The sheet stacking apparatus 110 includes an apparatus body 101 serving as a body of the image forming apparatus and a sheet cassette 102 which is one example of a sheet stacking portion. The sheet P is stacked in the sheet cassette 102. A sheet feeding portion 120 feeds the sheet P stacked in the sheet cassette 102. The image forming portion 140 forms an image on the sheet P fed by the sheet feeding portion 120. The sheet stacking apparatus 110 and the sheet feeding portion 120 constitute a sheet feeding apparatus SF.

The image forming portion 140 includes a laser scanner unit 10, process cartridges 20A through 20D, primary transfer rollers 30A through 30D, an intermediate transfer portion 40 and a secondary transfer roller 50. The process cartridges 20A through 20D include photosensitive drums 21A through 21D, charging rollers 22A through 22D and developing rollers 23A through 23D, respectively, and are configured to be attached to and detached from the apparatus body 101. The process cartridges 20A through 20D respectively correspond to yellow, magenta, cyan and black.

The charging rollers 22A through 22D homogeneously charge surfaces of the photosensitive drums 21A through 21D. The laser scanner unit 10 irradiates the surface of the photosensitive drums 21A through 21D with laser beams based on image information received from a computer or the like to form electrostatic latent images on the surfaces of the photosensitive drums 21A through 21D. The developing rollers 23A through 23D apply toners, i.e., developers, to the electrostatic latent images to form toner images on the surface of the photosensitive drums 21A through 21D.

The intermediate transfer portion 40 includes a driving roller 41, a tension roller 42, and an intermediate transfer belt 43 wrapped around the driving roller 41 and the tension roller 42. The intermediate transfer belt 43 is applied with a tensile force by the tension roller 42 and is driven to rotate by the driving roller 41. Primary transfer rollers 30A through 30D are disposed in an inner side of the intermediate transfer belt 43 and urged so as to press the photosensitive drums 21A through 21D. The primary transfer rollers 30A through 30D transfer the toner images onto the intermediate transfer belt 43 to form a full-color toner image on the intermediate transfer belt 43.

The sheet feeding portion 120 of the sheet feeding apparatus SF includes a pickup roller 121, a feed roller 122 and a separation roller 123. In parallel with an image forming process in the image forming portion 140, the sheet P stacked in the sheet cassette 102 is delivered by the pickup roller 121. The sheet P delivered by the pickup roller 121 is conveyed to the registration roller pair 130, being separated one by one by the feed roller 122 and the separation roller 123. As a leading edge of the sheet P abuts against the registration roller pair 130 in a stopped condition, a skew of the sheet P is corrected. The sheet P whose skew has been corrected is fed by the registration roller pair 130 at a timing synchronized with the toner image on the intermediate transfer belt 43.

The sheet P fed by the registration roller pair 130 is conveyed between the secondary transfer roller 50 and the intermediate transfer belt 43. The toner image on the intermediate transfer belt 43 is transferred onto the sheet P by the secondary transfer roller 50. After the transfer, the toner left on the intermediate transfer belt 43 is collected by a cleaning unit 44.

The sheet P onto which the toner image has been transferred by the secondary transfer roller 50 is conveyed to the fixing portion 150 disposed downstream of the secondary transfer roller 50 in a sheet conveyance direction. The fixing portion 150 includes a heating roller 151 and a pressure roller 152 and fixes the toner image onto the sheet P by heating and pressurizing the conveyed sheet P.

Disposed downstream of the fixing portion 150 in the sheet conveyance direction are a discharge roller pair 160 and an inversing roller pair 170. The sheet P on which the toner image has been fixed is conveyed to the discharge roller pair 160 and is discharged to a discharge tray 161 by the discharge roller pair 160.

In a case of performing duplex printing, the sheet P on which the toner image has been fixed on a front side (i.e., a first surface) by the fixing portion 150 is conveyed to the inversing roller pair 170 to be switched back by the inversing roller pair 170, and is conveyed to a duplex conveyance path 180.

Duplex conveyance roller pairs 181 and 182 are disposed along the duplex conveyance path 180. The sheet P which has been conveyed to the duplex conveyance path 180 is sent out to the registration roller pair 130 by the duplex conveyance roller pair 182 to correct a skew thereof. The sheet P whose skew has been corrected is fed by the registration roller pair 130 at a timing synchronized with a toner image on the intermediate transfer belt 43. The toner image formed by the image forming portion 140 is formed on a back side (i.e., a second surface) of the sheet P sent out of the registration roller pair 130. The toner image which has been formed on the sheet P is fixed by the fixing portion 150 and is discharged by the discharge roller pair 160 to the discharge tray 161.

Figure 2:
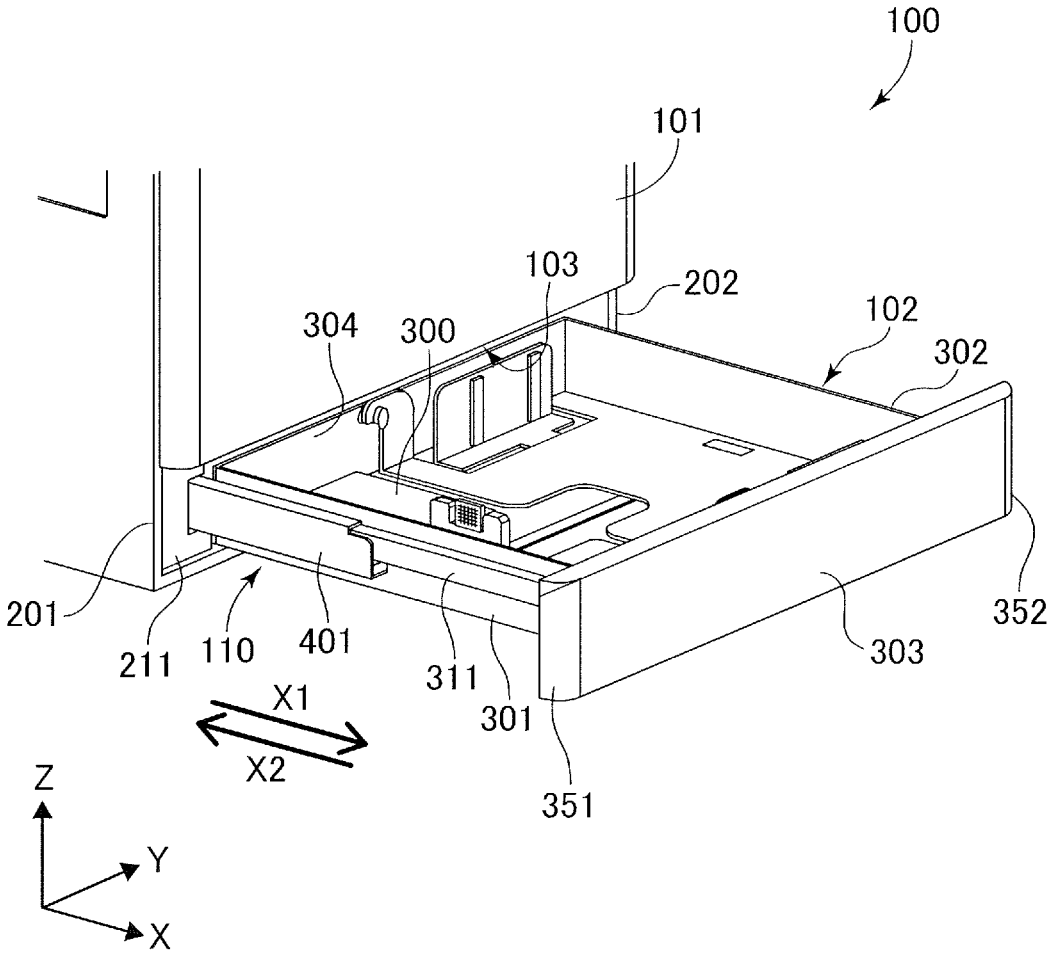
FIG. 2 is a perspective view illustrating a part of the image forming apparatus in a state in which a sheet cassette is drawn out of a mounting portion of an apparatus body in the first embodiment.

Next, the sheet stacking apparatus 110 of the sheet feeding apparatus SF provided in the image forming apparatus 100 will be described in detail. FIG. 2 is a perspective view illustrating a part of the image forming apparatus 100 in a state in which the sheet cassette 102 is drawn out of a mounting portion 103 of the apparatus body 101 in the first embodiment. As illustrated in FIG. 2, the apparatus body 101 includes the mounting portion 103 to which the sheet cassette 102 can be mounted. The sheet cassette 102 is configured to be inserted and drawn out between a mounted position and a draw-out position with respect to the mounting portion 103 of the apparatus body 101.

Here, a vertical direction of the apparatus body 101 will be denoted by 'Z' and two horizontal directions orthogonal to the vertical direction Z and orthogonal to each other will be denoted by 'X' and 'Y'. Mounting/draw-out directions of the sheet cassette 102 in the mounting portion 103 of the apparatus body 101 will be denoted by 'X' and a width direction of the mounting portion 103 will be denoted by 'Y'. Among the mounting/draw-out directions X, a draw-out direction of the sheet cassette 102 will be denoted by 'X1' and a mounting direction opposite to the draw-out direction X1 will be denoted by 'X2'. One side of the mounting portion 103 in the width direction Y is a left side, and the other side of the mounting portion 103 in the width direction Y is a right side. It is noted that a side from which the sheet cassette 102 is drawn out is a front side of the image forming apparatus 100, and a user operates the image forming apparatus 100 from the front side.

Figure 3:
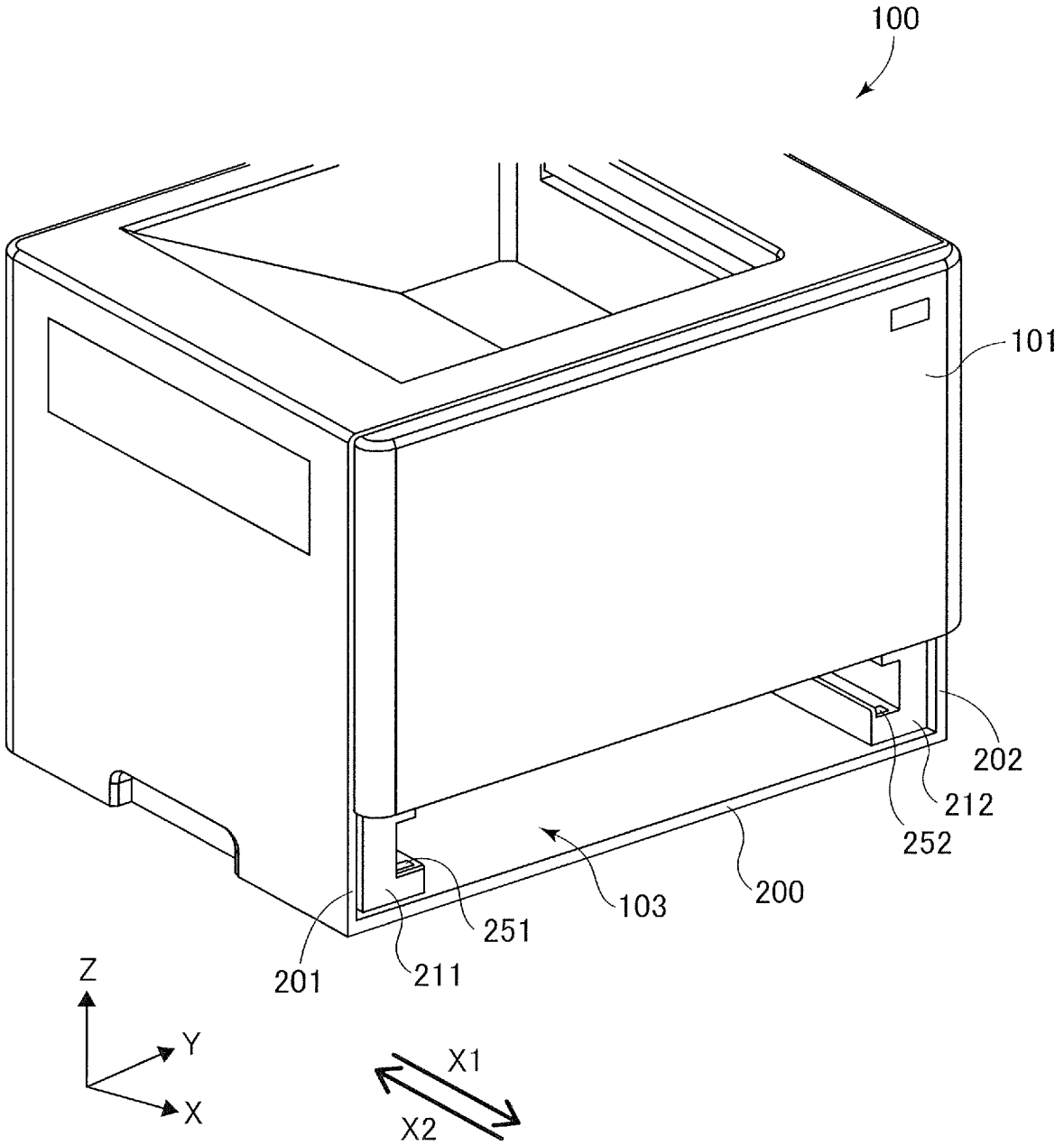
FIG. 3 is a perspective view illustrating a state in which the sheet cassette is taken out of the mounting portion of the apparatus body in the first embodiment.

FIG. 3 is a perspective view illustrating a state in which the sheet cassette 102 is taken out of the mounting portion 103 of the apparatus body 101 in the first embodiment. As illustrated in FIG. 3, the mounting portion 103 includes a bottom frame 200 and a pair of frames 201 and 202 erecting from the bottom frame 200 and spaced from each other in the width direction Y. A mounting space for the sheet cassette 102 is defined by these frames 200, 201 and 202.

A rail holder 211, which is one example of a rail supporting portion, is fixed on the left frame 201 among the pair of frames 201 and 202. A rail holder 212, which is one example of the rail supporting portion, is fixed on the right frame 202 among the pair of frames 201 and 202. The pair of rail holders 211 and 212 is formed so as to extend in the mounting/draw-out directions X and is disposed leaving a space in the width direction Y. It is noted that the rail holders 211 and 212 may be formed integrally with the apparatus body 101 (or, with the mounting portion 103). The rail holders 211 and 212 may be formed by molding synthetic resin and may also be molded integrally with the respective frames 201 and 202.

Figure 4:
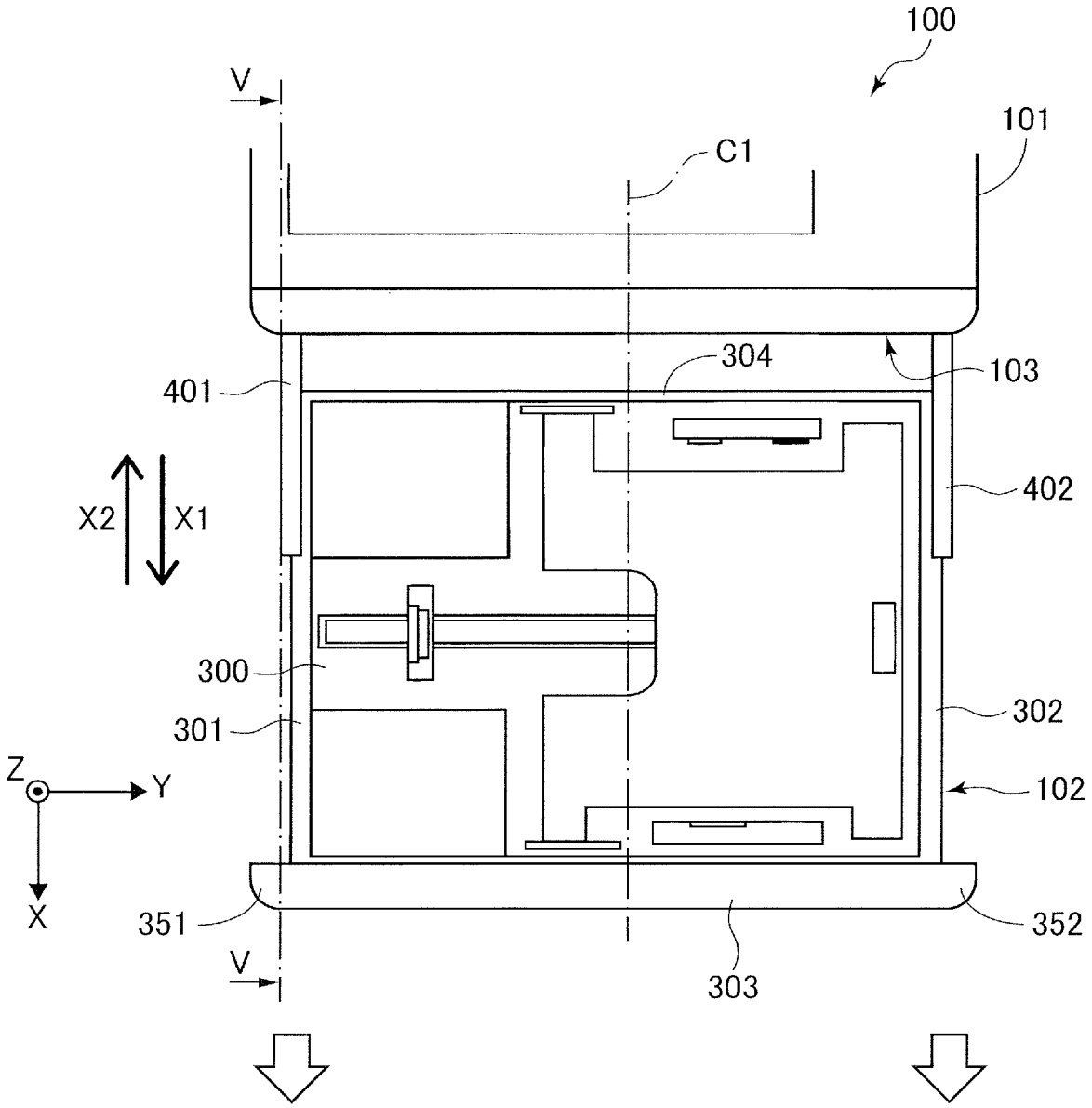
FIG. 4 is a plan view of a part of the image forming apparatus in the state in which the sheet cassette is drawn out of the mounting portion of the apparatus body in the first embodiment.

Here, a configuration of the sheet cassette 102 will be described with reference to FIGS. 2 through 4. It is noted that FIG. 4 is a plan view of the state in which the sheet cassette 102 is drawn out of the mounting portion 103 of the apparatus body 101 in the first embodiment. The sheet cassette 102 includes a bottom plate 300 and a pair of side plates 301 and 302 erecting from the bottom plate 300, spaced from each other in the width direction Y, and extending in the mounting/draw-out directions X. One side plate among the pair of side plates 301 and 302 is a left side plate 301 and another side plate is a right side plate 302.

The sheet cassette 102 also includes a side plate (referred to as a 'front side plate' hereinafter) 303 erecting on a downstream side in the draw-out direction X1 of the bottom plate 300 and extending in the width direction Y. The sheet cassette 102 also includes a side plate (referred to as a 'rear side plate' hereinafter) 304 erecting on an upstream side in the draw-out direction X1 of the bottom plate 300 and extending in the width direction Y. The front side plate 303 is a decorative (or an exterior) panel exposed outside of the apparatus body 101 even in a state where the sheet cassette 102 is mounted into the mounting portion 103 of the apparatus body 101. The front side plate 303 includes grip portions 351 and 352 on both end portions thereof in the width direction Y such that the sheet cassette 102 can be moved in the mounting/draw-out directions X by holding at least one of the grip portions 351 and 352.

The first embodiment adopts an extension rail in order to downsize the sheet stacking apparatus 110 and the image forming apparatus 100. That is, a rail (i.e., an extension rail) 401 that extends in the mounting/draw-out directions X is disposed between the left side plate 301 of the sheet cassette 102 and the rail holder 211, and a rail (i.e., another extension rail) 402 that extends in the mounting/draw-out directions X is disposed between the right side plate 302 of the sheet cassette 102 and the rail holder 212. The rail holder 211 supports the extension rail 401 to be slidable in the mounting/draw-out directions X and the rail holder 212 supports the extension rail 402 to be slidable in the mounting/draw-out directions X.

As illustrated in FIG. 2, a protruded portion 311 that extends in the mounting/draw-out directions X is provided on an outside of (i.e., on a side surface of) the left side plate 301 integrally with the left side plate 301, and is disposed such that the extension rail 401 is fitted with the protruded portion 311. A protruded portion (not illustrated) having a substantially same structure with the protruded portion 301 and extending in the mounting/draw-out directions X is provided on an outside of (i.e., on a side surface of) the right side plate 302 integrally with the right side plate 302, and is disposed such that the extension rail 402 is fitted with the protruded portion not illustrated. Thereby, the sheet cassette 102 is supported by the pair of extension rails 401 and 402, to be slidable in the mounting/draw-out directions X with respect to the pair of extension rails 401 and 402. Thus, the sheet cassette 102 is supported by the pair of rail holders 211 and 212 through the pair of extension rails 401 and 402. The protruded portions 311 of the left and right side plates 301 and 302 are formed integrally with the cassette by molding synthetic resin, and the extension rails 401 and 402 are formed of sheet metals approximately into a depressed shape (or, a rectangular shape with one side open) in section.

A stopper not illustrated is provided between the rail holders 211 and 212 and the extension rails 401 and 402 to restrict the extension rails 401 and 402 from being drawn out further when the extension rails 401 and 402 are drawn out at the maximum. Stoppers not illustrated are also provided between the extension rails 401 and 402 and the protruded portion 311 and the protruded portion not illustrated on the right side plate 302 to restrict the sheet cassette 102 from being drawn out further when the sheet cassette 102 is drawn out at the maximum. This arrangement makes it possible to draw the sheet cassette 102 out of the apparatus body 101 without being derailed.

When the sheet cassette 102 is drawn out to the draw-out position, as illustrated in FIG. 4, an entire sheet stacking region of the sheet cassette 102 is exposed in the state in which the sheet cassette 102 is supported by the pair of extension rails 401 and 402. That is, the sheet cassette 102 can be drawn out to a position where the rear side plate 304 is exposed outside. This arrangement makes it possible to readily replenish sheets P into the sheet cassette 102. Still further, as compared to a configuration in which a sheet cassette is supported directly by the apparatus body, an apparatus size in the mounting/draw-out directions X can be shortened and the entire apparatus can be downsized by supporting the sheet cassette 102 by the pair of extension rails 401 and 402. It is noted that the sheet cassette 102 needs not be always drawn out to the position where the rear side plate 304 is exposed, and the rear side plate 304 may be located within the apparatus body 101 as long as a sheet of maximum size that can be stored in the sheet cassette 102 can be loaded or taken out.

By the way, a user is supposed to hold at least one of the grip portions 351 and 352 of the front side plate 303 and slidingly draws out the sheet cassette 102 in the draw-out direction X1 for replenishing the sheet P into the sheet cassette 102. Still further, after finishing replenishing the sheet P into the sheet cassette 102, the user will hold at least one of the grip portions 351 and 352 of the front side plate 303 or press any part of the front side of the front side plate 303 to slidingly insert the sheet cassette 102 into the mounting direction X2.

Here, an imaginary X-Z plane extending in the mounting/draw-out directions X and the vertical direction Z at a middle position of the width direction Y of the mounting portion 103 (i.e., a middle position of the sheet cassette 102) is defined as a reference plane C1. The grip portions 351 and 352 are disposed to be offset in left and right with respect to the reference plane C1. Therefore, the user can mount and draw out the sheet cassette 102 into/out of the mounting portion 103 by holding one or both of the grip portions 351 and 352.

Figure 14:
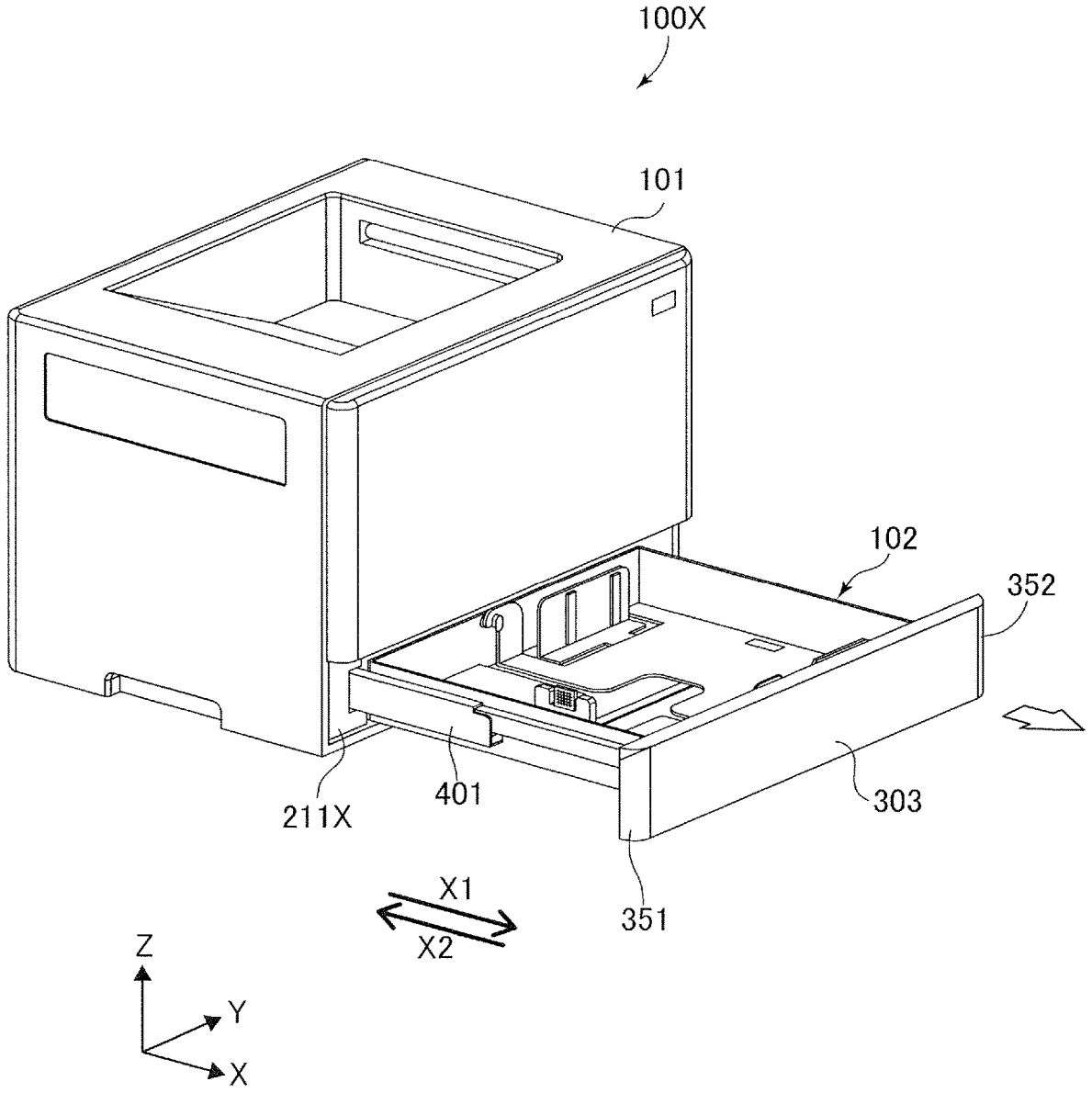
FIG. 14 is a perspective view illustrating an image forming apparatus of the comparative example.
Figure 15:
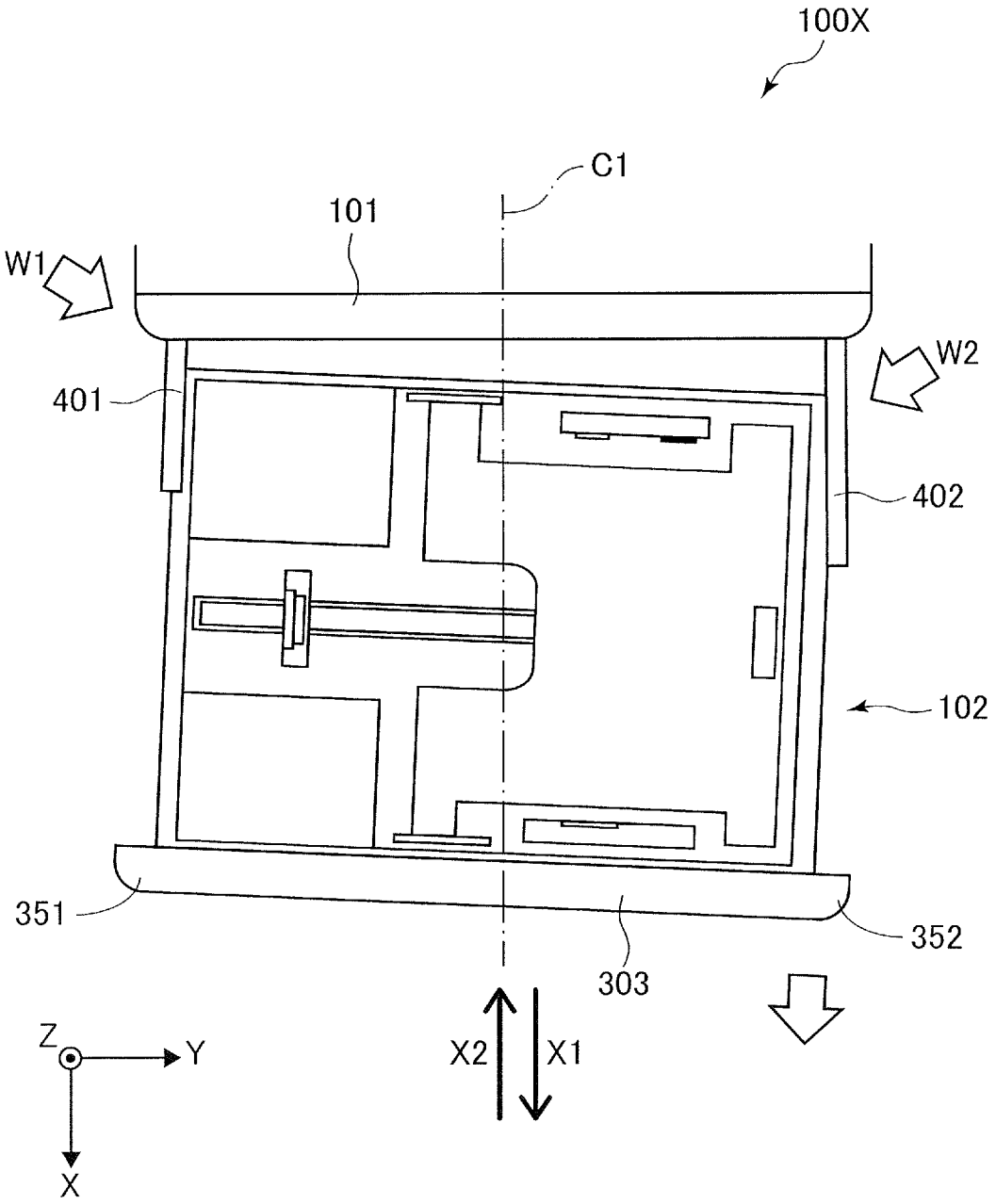
FIG. 15 is a plan view illustrating a part of the image forming apparatus of the comparative example.

A comparative example of the image forming apparatus will be described below. FIG. 14 is a perspective view illustrating the image forming apparatus 100X of the comparative example and FIG. 15 is a plan view illustrating a part of the image forming apparatus 100X of the comparative example. FIGS. 14 and 15 illustrate the state in which the sheet cassette 102 is drawn out of the apparatus body 101. It is noted that same components of the image forming apparatus 100X of the comparative example with those of the image forming apparatus 100 of the first embodiment will be denoted by the same reference numerals.

The sheet cassette 102 is slidably supported by the extension rails 401 and 402 also in the image forming apparatus 100X of the comparative example. Then, the extension rails 401 and 402 are slidably supported by a pair of rail holders 211X. It is noted that in FIG. 14, only one rail holder 211X among the pair of rail holders is illustrated and another rail holder is not illustrated because it is hidden. The pair of rail holders is not illustrated also in FIG. 15 because they are hidden.

In a case where each grip portion 351 or 352 is disposed to be offset in left or right with respect to the reference plane C1, the sheet cassette 102 is not always drawn out straightly and may be drawn out obliquely as illustrated in FIG. 15. The same situation may happen in a case where the user operates by one hand even if the grip portion is located on the reference plane C1. This is because the user often operates the apparatus by one hand and operating force for drawing out the sheet cassette 102 is not necessarily applied to the sheet cassette 102 straightly in the draw-out direction, thus the sheet cassette 102 being drawn out obliquely. Because operating force for drawing out the sheet cassette 102 is applied on the grip portion 352 in the case of FIGS. 14 and 15, the extension rail 401 slides belatedly. Due to that, the extension rail 401 inclines, and the sheet cassette 102 is drawn out obliquely. Then, sliding friction generated in parts indicated by arrows W1 and W2 as illustrated in FIG. 15 for example increase, requiring more operating force to draw out the sheet cassette 102. Thus, the sheet cassette 102 tends to be inclined in a case where the sheet cassette 102 is drawn out by one hand as compared to a case where the sheet cassette 102 is drawn out by both hands.

Then in the first embodiment, a rotatable rail roller 251, which is one example of a rotator, is provided on the rail holder 211 as illustrated in FIG. 3. The rail roller 251 is disposed on the rail holder 211 so as to be in contact with the extension rail 401. It is noted that the rail roller 251 may be rotatably provided on the extension rail 401 so as to be in contact with the rail holder 211. That is, the rail roller 251 may be provided in either the rail holder 211 or the extension rail 401 such that the rail roller 251 is in contact with the other of the rail holder 211 and the extension rail 401.

Still further, a rail roller 252, which is one example of another rotator, is rotatably provided on the rail holder 212 as illustrated in FIG. 3 in the first embodiment. The rail roller 252 is disposed in the rail holder 212 so as to be in contact with the extension rail 402. It is noted that the rail roller 252 may be rotatably provided on the extension rail 402 so as to be in contact with the rail holder 212. That is, the rail roller 252 may be provided in either the rail holder 212 or the extension rail 402 such that the rail roller 252 is in contact with the other of the rail holder 212 and the extension rail 402.

Figure 5A:
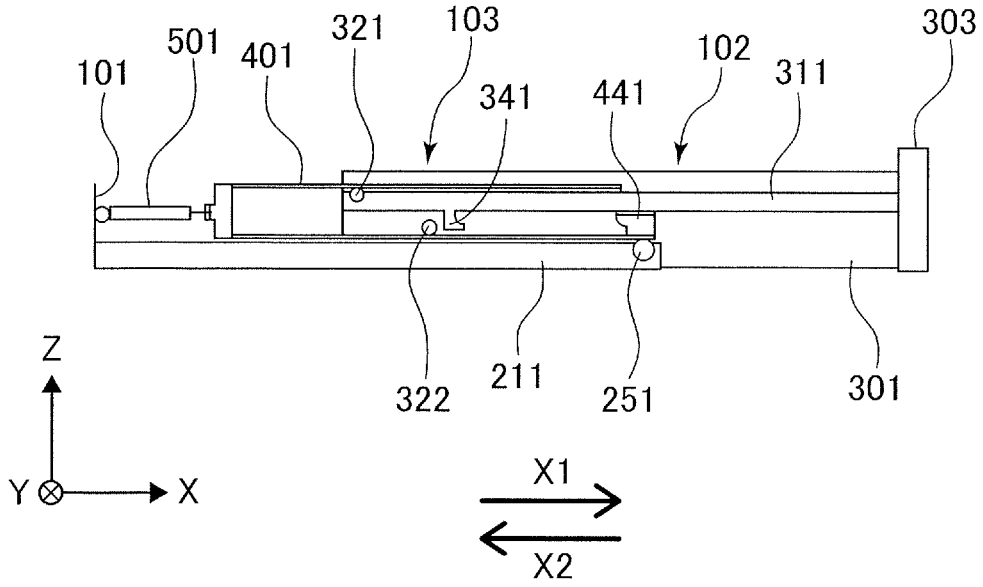
FIG. 5A is a section view of a part of the image forming apparatus along a line V-V in FIG. 4.
Figure 5B:
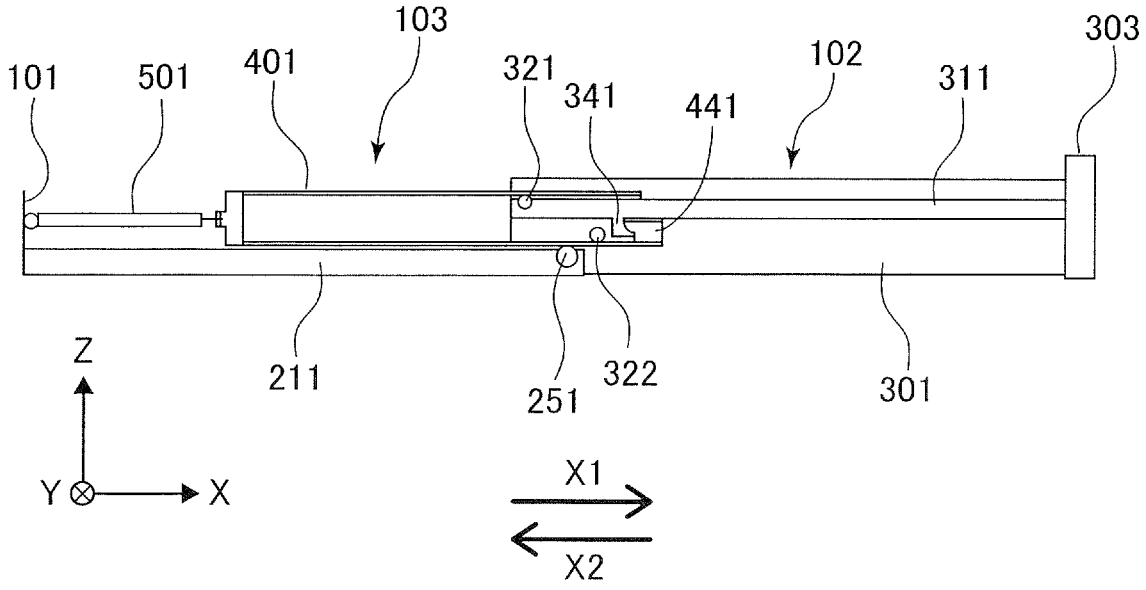
FIG. 5B is another section view of the part of the image forming apparatus along a line V-V in FIG. 4.

FIGS. 5A and 5B are section views of a part of the image forming apparatus in a section indicated by a line V-V in FIG. 4. FIG. 5A illustrates a state in which the sheet cassette 102 is on the way of being drawn out of the mounting portion 103 of the apparatus body 101, and FIG. 5B illustrates a state in which the sheet cassette 102 is drawn out further from the state illustrated in FIG. 5A. Among a pair of supporting structures supporting the sheet cassette 102, the left side supporting structure related to the grip portion 352 on the right side will be described below. The right side supporting structure has substantially the same structure and a description thereof will be omitted here. That is, the pair of supporting structures supporting the sheet cassette 102 are formed and are disposed symmetrically with respect to the reference plane C1 as illustrated in FIG. 4 in the first embodiment.

As illustrated in FIGS. 5A and 5B, an upper-face roller 321 that is in contact with an upper inner surface of the extension rail 401 is rotatably provided outside of the left side plate 301 of the sheet cassette 102. Further, a lower-face roller 322 that is in contact with a lower inner surface of the extension rail 401 is rotatably provided outside of the left side plate 301 of the sheet cassette 102. With these upper and lower-face rollers 321 and 322, the sheet cassette 102 slides smoothly in the mounting/draw-out directions X with respect to the extension rail 401. A rail hook 441 serving as a first engage portion is provided at a downstream end in the draw-out direction X1 of the extension rail 401, and a cassette hook 341 serving as a second engage portion that projects downward from the protruded portion 311 is provided on the left side plate 301 of the sheet cassette 102. The extension rail 401 is urged in the mounting direction X2 by a storage spring 501, which serves as an elastic member. The storage spring 501 is a coil spring for example. One end of the storage spring 501 is fixed to a rear side of the mounting portion 103 of the apparatus body 101 and another end is fixed to an upstream side in the draw-out direction X1 of the extension rail 401. The rail roller 251 is provided on a downstream end portion in the draw-out direction X1 of the rail holder 211. It is noted that the storage spring 501 will not draw-in the sheet cassette 102 into the mounting portion 103 in a state in which the sheet cassette 102 has been drawn out to the draw-out position as illustrated in FIG. 4. That is, a magnitude of elastic force of the storage spring 501 is set to be small so that the sheet cassette 102 is not drawn-in to the mounting portion 103, overcoming a weight of the sheet cassette 102 and sliding resistance between the extension rail 401 and the rail holder 211.

In a state as illustrated in FIG. 5A, the cassette hook 341 is separated from the rail hook 441 in the mounting/draw-out directions X. When the sheet cassette 102 is operated and is slid in the draw-out direction X1, the cassette hook 341 approaches gradually to the rail hook 441. While the cassette hook 341 is separated from the rail hook 441, the extension rail 401 abuts with the stopper not illustrated and is kept at a home position as illustrated in FIG. 5A by the urging force in the mounting direction X2 (i.e., the elastic force) of the storage spring 501. Thereby, the sheet cassette 102 can be slid in the draw-out direction X1 with respect to the extension rail 401 and the apparatus body 101.

In this case, the upper-face roller 321 and the lower-face roller 322 rotatably provided on the sheet cassette 102 rotate in contact with an inner surface of the extension rail 401 in drawing out the sheet cassette 102. The sliding resistance for making the sheet cassette 102 in the draw-out direction X1 slide with respect to the extension rail 401 is reduced by these rollers 321 and 322.

Figure 6:
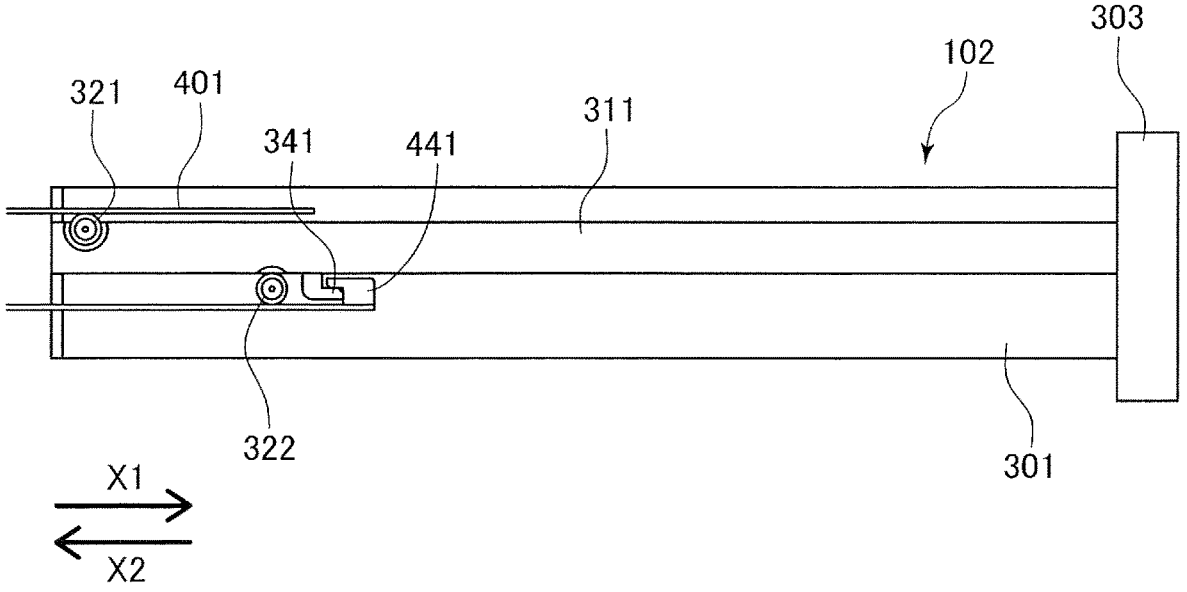
FIG. 6 illustrates the sheet cassette and an extension rail which are being drawn out of the mounting portion of the apparatus body of the first embodiment.

When the user draws out the sheet cassette 102 further in the draw-out direction X1, the cassette hook 341 engages, or comes into contact, with the rail hook 441 as illustrated in FIG. 5B. FIG. 6 illustrates the sheet cassette 102 and the extension rail 401 that are being drawn out of the mounting portion 103 of the apparatus body 101 in the first embodiment. The operating force applied by the user is transmitted from the sheet cassette 102 to the extension rail 401 through the engagement of these hooks 341 and 441. Then, the extension rail 401 slides in the draw-out direction X1 together with the sheet cassette 102, stretching the storage spring 501 against the urging force (or the elastic force) of the storage spring 501.

Figure 7:
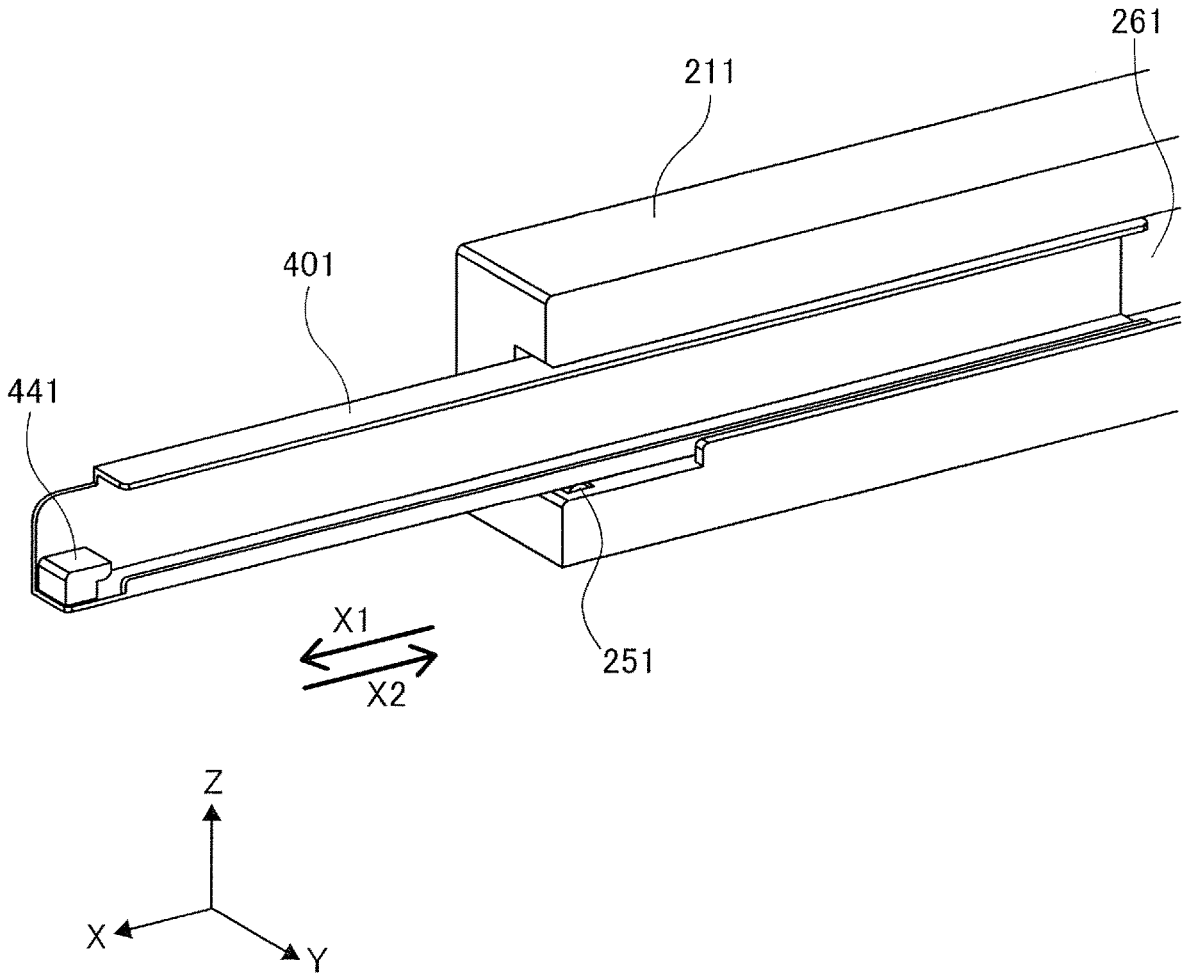
FIG. 7 is a perspective view illustrating an arrangement relation between a rail holder and the extension rail in the first embodiment.

FIG. 7 is a perspective view illustrating an arrangement of the rail holder 211 and the extension rail 401. As illustrated in FIG. 7, the rail holder 211 includes a hollow portion 261 which extends in the mounting/draw-out directions X and whose aperture is open toward the middle position (i.e., to the inner side) in the width direction Y of the mounting portion 103 to slidably support the extension rail 401 in the mounting/draw-out directions X. The extension rail 401 is disposed in the hollow portion 261 extending in the mounting/draw-out directions X. The rail roller 251 is disposed inside the hollow portion 261, being abutted with a lower surface of the extension rail 401.

Figure 8A:
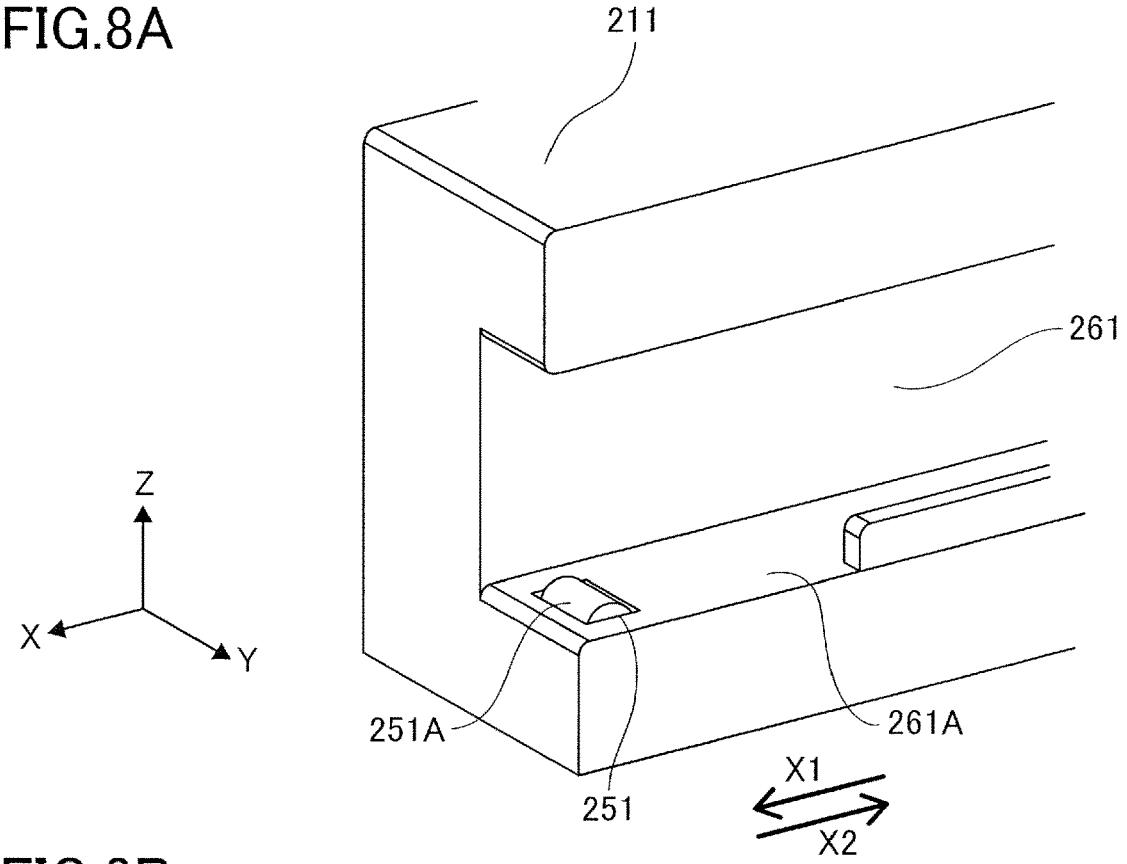
FIG. 8A is a perspective view illustrating a downstream end in a draw-out direction of the rail holder.

FIG. 8A is a perspective view illustrating a downstream end in the draw-out direction X1 of the rail holder 211. The rail roller 251 is supported by the rail holder 211 such that a peripheral surface 251A thereof projects slightly out of a supporting surface 261A of the hollow portion 261 in the direction Z toward an inner space of the hollow portion 261.

Figure 8B:
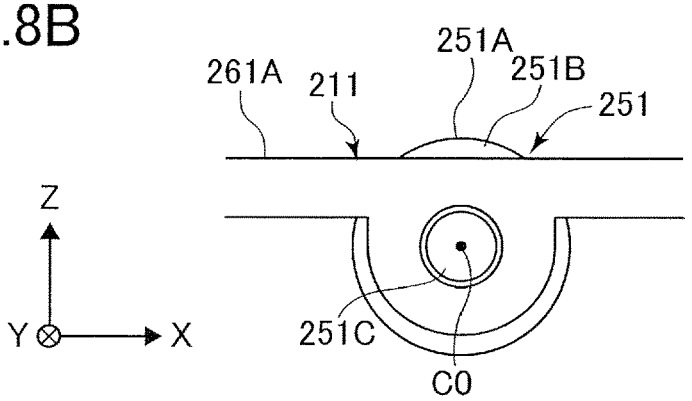
FIG. 8B illustrates a supporting structure of a rail roller viewed in a width direction.
Figure 8C:
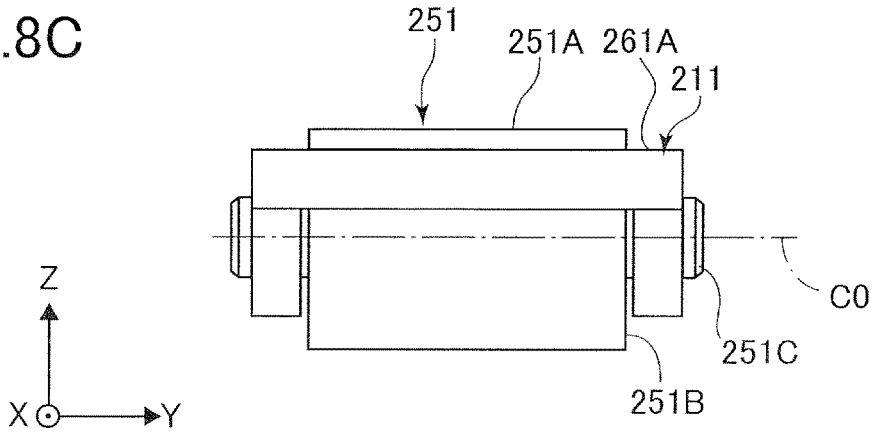
FIG. 8C illustrates the supporting structure of the rail roller viewed in a mounting direction.

FIG. 8B illustrates the supporting structure of the rail roller 251 viewed in the width direction Y and FIG. 8C illustrates the supporting structure of the rail roller 251 viewed in the mounting direction X2. The rail roller 251 is a cylindrical (or columnar) roll that rotates on a rotation axis C0 extending in the width direction Y More specifically, the rail roller 251 includes a roller body 251B having a cylindrical peripheral surface 251A and a shaft 251C constructed in a body with the roller body 251B. Both ends of the shaft 251C are supported by the rail holder 211 through bearings. Thereby, the roller body 251B and the shaft 251C rotate in a body centering on the rotation axis C0. It is noted that the structure of the rail roller 251 is not limited to such configuration, and a cylindrical roller may be rotatably fitted to a shaft integrated with the rail holder 211. In that case, the shaft does not rotate, and only the cylindrical roller supported by the shaft rotates.

Figure 9A:
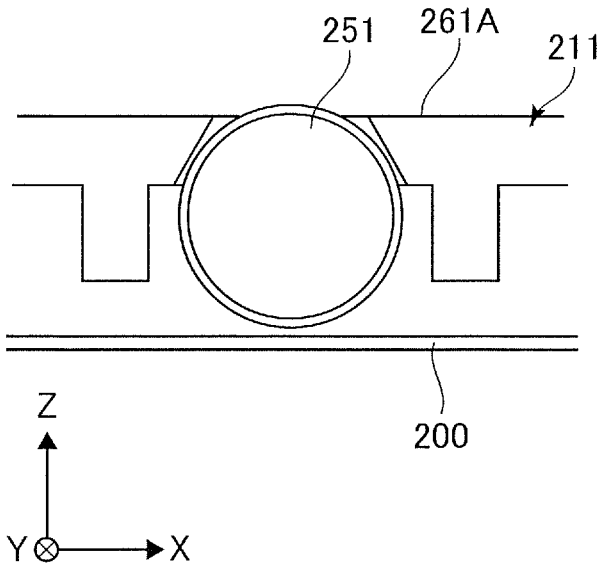
FIG. 9A illustrates a supporting structure of a modified rail roller viewed in the width direction.
Figure 9B:
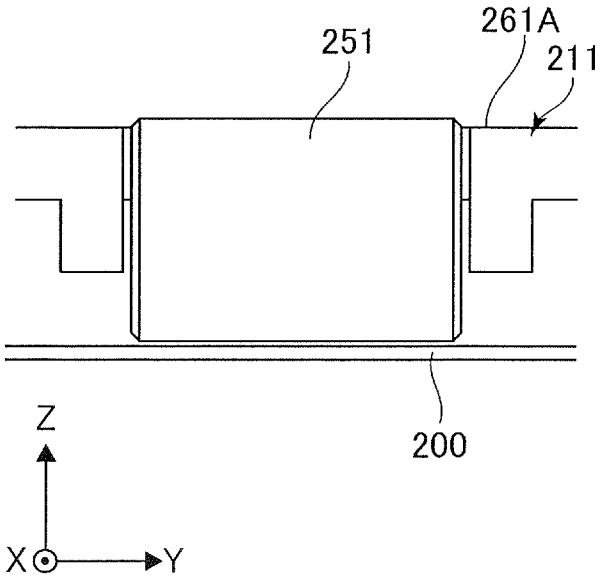
FIG. 9B illustrates the supporting structure of the modified rail roller viewed in the mounting direction.

FIG. 9A illustrates a supporting structure of a modified rail roller 251 viewed in the width direction Y and FIG. 9B illustrates the supporting structure of the modified rail roller 251 viewed in the mounting direction X2. As illustrated in FIGS. 9A and 9B, the supporting structure of the rail roller 251 does not necessarily adopt a bearing but may adopt such a configuration that the rail roller 251 is held rotatably between the rail holder 211 and the bottom frame 200. Still further, although the rotator is preferable to be cylindrical or columnar, the shape of the rotator is not limited to that and may be a spherical body for example. It is noted that the rail roller 252 may be modified in the same manner as this example.

With the configuration described above, the lower surface of the extension rail 401 and 402 respectively abut with the rotatable rail rollers 251 and 252. Therefore, the sliding resistance in sliding the extension rails 401 and 402 in the mounting/draw-out directions X with respect to the rail holders 211 and 212 is reduced. Accordingly, the extension rails 401 and 402 slide smoothly in the mounting/draw-out directions X with respect to the rail holders 211 and 212.

Figure 10A:
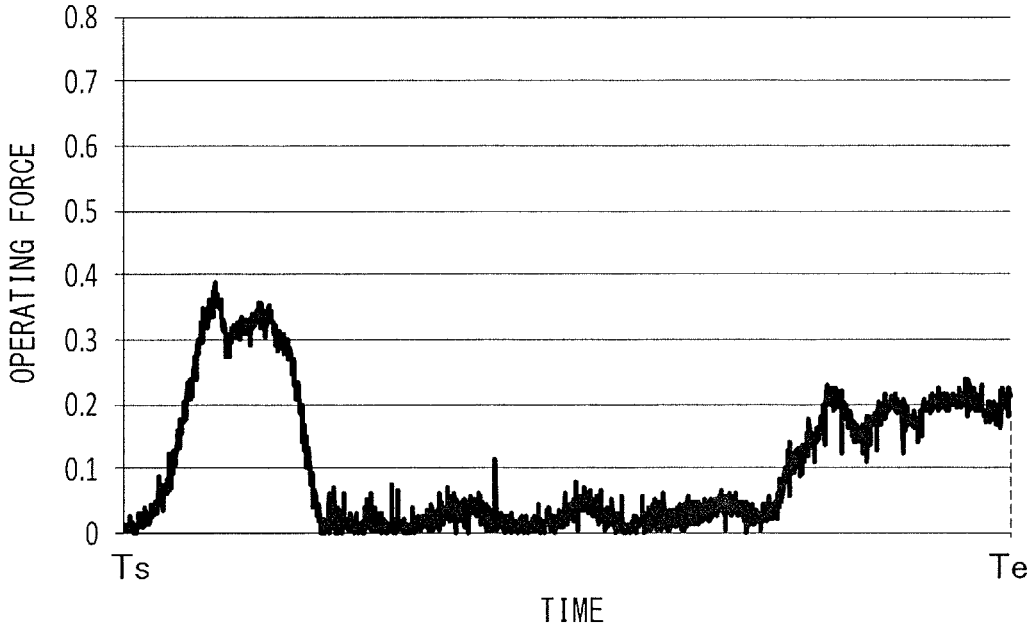
FIG. 10A is a graph indicating measurement results of operating force in drawing out the sheet cassette in the image forming apparatus of the first embodiment.
Figure 10B:
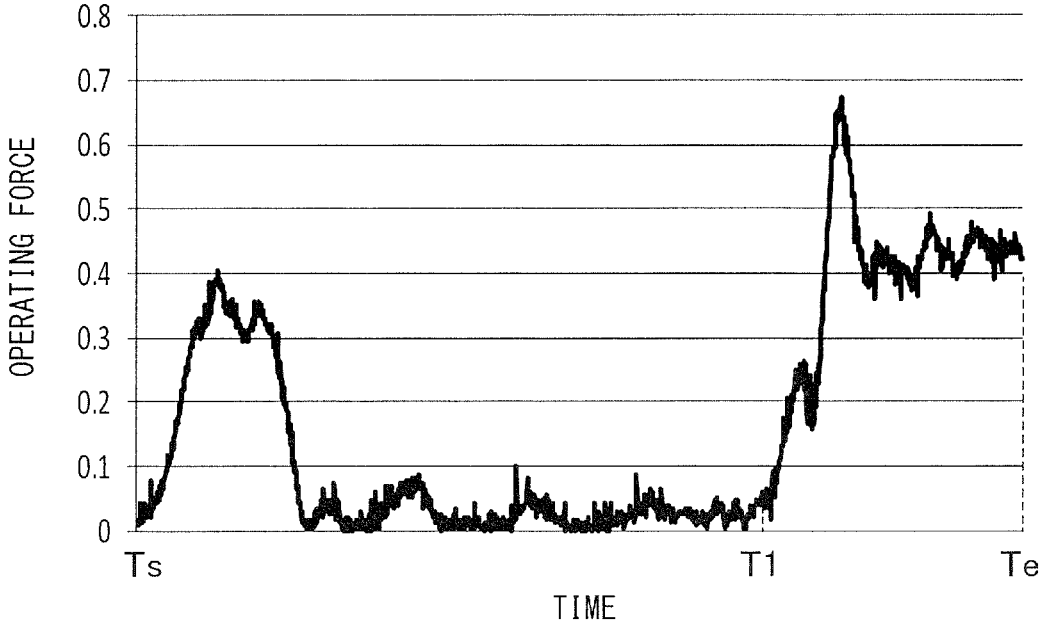
FIG. 10B is a graph indicating measurement results of operating force in drawing out the sheet cassette in an image forming apparatus of a comparative example.

FIG. 10A is a graph indicating measurement results of the operating force in drawing out the sheet cassette 102 in the image forming apparatus 100 of the first embodiment, and FIG. 10B is a graph indicating measurement results of operating force in drawing out the sheet cassette 102 in the image forming apparatus 100X of the comparative example. It is noted that the image forming apparatus 100X of the comparative example does not include rail rollers 251 and 252 like the first embodiment. In FIGS. 10A and 10B, the vertical axis represents the magnitude of operating force in drawing out the sheet cassette 102, and the horizontal axis represents elapsed time from a point of time Ts when the sheet cassette 102 is started to be drawn out until a point of time Te when the sheet cassette 102 is finished being drawn out. The operating force represented by the vertical axis indicates numerical values, i.e., relative values, standardized by the same reference value both in the first embodiment and the comparative example. For each graph, the operating force is measured by operating the grip portion 352 on the right side with respect to the reference plane C1 in the draw-out direction X1.

As illustrated in FIG. 10A, in the measurement results of the first embodiment, while the operating force indicates values higher more or less in the start of the draw out, the operating force is stable after that without significantly varying until the end of the draw out. In the comparative example, as illustrated in FIG. 10B, the operating force indicates values higher more or less in the start of the draw out almost in the same manner with the first embodiment, but increase again from a point of time T1 and then stays high until the end of the draw out. The point of time T1 is timing when the cassette hook 341 on the left side with respect to the reference plane C1 engages with the rail hook 441. That is, the higher operating force is required because a sliding load between the extension rail 401 and a rail holder 211X is high.

In the first embodiment, in contrast, the sliding friction between the rail holders 211 and 212 and the extension rails 401 and 402 is reduced by rotation of the rail rollers 251 and 252. Therefore, the extension rails 401 and 402 slide smoothly in the mounting/draw-out directions X with respect to the rail holders 211 and 212, enabling to operate the sheet cassette 102 stably with a lower operating force. Thus, the operability of the sheet cassette 102 can be improved while realizing downsizing of the image forming apparatus 100 by adopting the extension rail system.

The rail rollers 251 and 252 are provided on the downstream end portions in the draw-out direction X1 of the rail holders 211 and 212. Therefore, the sheet cassette 102 can continuously abut with the extension rails 401 and 402 while the sheet cassette 102 slides between the mounted position and the draw-out position. Accordingly, the sheet cassette 102 can be operated more stably.

The rail rollers 251 and 252 are disposed on the rail holders 211 and 212 such that the rotation axis C0 thereof is in parallel with an imaginary line extending in the width direction Y. Therefore, while the extension rails 401 and 402 move smoothly in the mounting/draw-out directions X while rotating the rail rollers 251 and 252, the extension rails 401 and 402 are restricted from moving (i.e., from being deflected) in the width direction Y orthogonal to the mounting/draw-out directions X by receiving frictional force from the rail rollers 251 and 252. In particular, the extension rails 401 and 402 are restricted from deflecting outward in the width direction Y by the rail rollers 251 and 252. This arrangement makes it possible to suppress the extension rail 401 or the extension rail 402 from being inclined in drawing the sheet cassette 102 out of the mounting portion 103 and to operate the sheet cassette 102 more stably.

For instance, in the comparative example as illustrated in FIG. 15, if the grip portion 352 on the right side with respect to the reference plane C1 is pulled in the draw-out direction X1, the extension rail 401 on the left side opposite to the grip portion 352 is inclined. In the first embodiment, however, the extension rail 401 is guided in the mounting/draw-out directions X, is restricted from shifting in the width direction Y by the left rail roller 251 and can be effectively suppressed from being inclined. Thereby, the extension rail 401 and the sheet cassette 102 can be slid approximately straightly in the draw-out direction X1, and the operability of the sheet cassette 102 can be improved.

That is, when the user operates the grip portion 352 based on the middle position in the width direction Y, the rail roller 251 suppresses the extension rail 401 from being inclined, thus enabling to smoothly draw out the sheet cassette 102. When the user operates the grip portion 351 on the left side, the rail roller 252 suppresses the extension rail 402 from being inclined, thus enabling to smoothly draw out the sheet cassette 102.

Here, in a case where the grip portion 352 disposed on the right side with respect to the reference plane C1 is operated, the rail roller 251 on the rail holder 211 disposed on the left side functions so as to suppress inclination of the extension rails 401 and 402. Still further, in a case where the grip portion 351 disposed on the left side with respect to the reference plane C1 is operated, the rail roller 252 on the rail holder 212 disposed on the right side functions so as to suppress inclination of the extension rails 401 and 402. Thus, the rail roller disposed on one side in the width direction Y with respect to the reference plane C1 shows its function of suppressing inclination of the extension rails when the grip portion disposed on the other side in the width direction Y in the front side plate 303 is operated. Here, in a case where the one side in the width direction Y with respect to the reference plane C1 is the left side, the right side opposite to the left side is the other side. In a case where the one side in the width direction Y with respect to the reference plane C1 is the right side, the left side opposite to the right side is the other side.

In the first embodiment described above, the grip portions 351 and 352 are formed on the both end portions in the width direction Y of the front side plate 303. That is, the first embodiment is an embodiment in which the grip portion 352, the extension rail 402 and the rail holder 212 serving respectively as the second grip portion, the second rail and the second rail supporting portion are provided on the opposite side in the width direction from the grip portion 351, the extension rail 401 and the rail holder 211, which are provided respectively as the first grip portion, the first rail and the first rail supporting portion. However, the grip portion may be provided only one side in the width direction Y, omitting the other grip portion in the width direction. In this case, the rail roller is disposed only in the rail holder on the other side in the width direction Y among the pair of rail holders. For instance, in a case where the left grip portion 351 is omitted and the right grip portion 352 is provided in the front side plate 303, the rail roller 251 is disposed at least on the left rail holder 211 and the right rail roller 252 may be omitted. In the same manner, in a case where the right grip portion 352 is omitted and the left grip portion 351 is provided in the front side plate 303, the rail roller 252 on the right side is disposed at least on the left right rail holder 212 and the left rail roller 251 on the left side may be omitted. It is preferable to dispose the rail rollers 251 and 252 in the both rail holders 211 and 212 in that the user can operate any part of the front side plate 303. In a case where the grip portion is provided on the reference plane C1, it is preferable to dispose the rail rollers 251 and 252 in the both rail holders 211 and 212 because the user may applies stronger force either on the right side or on the left side.

The sheet cassette 102, into which the sheets has been loaded at the draw-out position, is pushed into the mounting portion 103 such that the front side plate 303 or the grip portions 351 and 352 are pressed from the front side. Because the extension rail 401 is urged in the mounting direction X2 by the storage spring 501 at this time, the extension rail 401 also moves in the mounting direction X2 in a state in which the rail hook 441 is kept engaged with the cassette hook 341. When the extension rail 401 reaches its home position, the extension rail 401 stops and only the sheet cassette 102 being pressed is moved into the mounted position. Then, the sheets stacked in the sheet cassette 102 can be fed by the sheet feeding portion 120.

Second Embodiment

Figure 11:
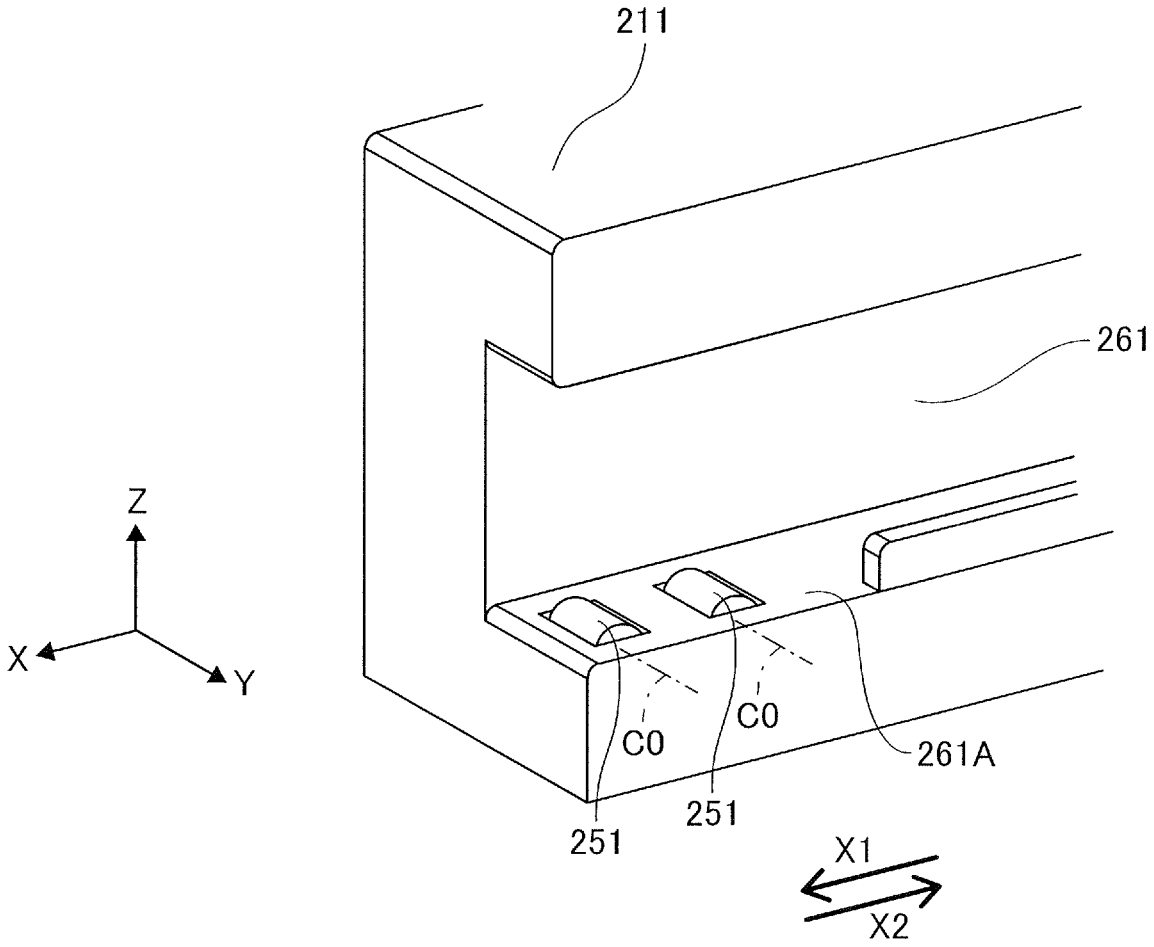
FIG. 11 is a perspective view illustrating a downstream end of a rail holder in a draw-out direction, which is provided in an image forming apparatus of a second embodiment.

Next, an image forming apparatus of a second embodiment will be described. FIG. 11 is a perspective view illustrating a downstream end in the draw-out direction X1 of a rail holder 211, which provided in an image forming apparatus of a second embodiment. In the first embodiment, one rail roller 251 is disposed on one rail holder 211 has been described. In the second embodiment, a plurality of rail rollers 251, which are one example of a plurality of rotators, are arrayed in parallel while leaving a space in the draw-out direction X1 between each neighboring rotators (i.e., between the two rollers 251 and 251 in this embodiment) as illustrated in FIG. 11. Two rail rollers 251 are disposed in the example illustrated in FIG. 11. Because the configuration of the second embodiment other than that is substantially the same as that of the first embodiment, a description thereof will be omitted here. It is noted that in the second embodiment, similarly to the first embodiment as shown in FIG. 4, it will be mainly explained such a case where operating force in the draw-out direction X1 is applied to the grip portion 352 on the right side with respect to the reference plane C1. Still further, similarly to the first embodiment, in a case where one side in the width direction Y with respect to the reference plane C1 is referred to as the left side, the other side is the right side. In a case where one side in the width direction Y with respect to the reference plane C1 is referred to as the right side, the other side is the left side.

In the second embodiment, the plurality of rail rollers 251 are rotatably supported by the rail holder 211 as illustrated in FIG. 11, and each abuts with the lower surface of the extension rail 401 (see FIG. 2). Accordingly, the extension rail 401 is supported to be slidable in the mounting/draw-out directions X on the plurality of rail rollers 251. Thereby, pressure acting on each rail roller 251 when the extension rail 401 is drawn out in the draw-out direction X1 is reduced, and the extension rail 401 slides more smoothly in the mounting/draw-out directions X.

Still further, the plurality of rail rollers 251 are disposed such that the rotation axes C0 thereof are in parallel with each other, and each abuts with the lower surface of the extension rail 401. Accordingly, this arrangement makes it possible to restrict the extension rail 401 from shifting outside in the width direction Y more effectively as compared to the first embodiment (see FIG. 2) and to draw out the sheet cassette 102 in the draw-out direction X1 while suppressing inclination of the sheet cassette 102.

In the comparative example as illustrated in FIG. 15, if the grip portion 352 on the right side with respect to the reference plane C1 is pulled out in the draw-out direction X1, the extension rail 401 on the left side (i.e., the opposite side from the right side) may be inclined. In the second embodiment, however, the extension rail 401 is restricted from deflecting in the width direction Y and is prevented from being inclined effectively by the plurality of rail rollers 251 on the left side. This arrangement makes it possible to slide the extension rail 401 and the sheet cassette 102 approximately straightly in the draw-out direction X1, thus improving operability of the sheet cassette 102. Still further, because the plurality of rail rollers 251 is disposed in adjacent to each other, a load applied to each rail roller 251 is reduced and durability of the rail roller 251 is improved.

The front side plate 303 in the second embodiment is also provided with the grip portion 351 (see FIG. 4) on the left side similarly to the first embodiment. Therefore, the rail roller 252 in FIG. 4 will be one of a plurality of rail rollers in the present embodiment which are disposed on the rail holder 212 (see FIG. 3) on the right side at positions symmetrical to the plurality of rail rollers 251 with the reference plane C1 as a plane of symmetry.

It is noted that, as similar to the first embodiment, in a case where the grip portion 351 on the left side is omitted and only the grip portion 352 on the right side is provided in the front side plate 303, the rail rollers 251 are disposed at least on the rail holder 211 on the left side and the right rail roller 252 may be omitted. In a case where the right grip portion 352 is omitted and the left grip portion 351 is formed in the front side plate 303, the rail rollers 252 are disposed at least in the left right rail holder 212 and the left rail roller 251 may be omitted. It is preferable to dispose the rail rollers 251 and 252 in the both rail holders 211 and 212 in that the user can operate any part of the front side plate 303. In a case where the grip portion is provided on the reference plane C1, it is preferable to dispose the rail rollers 251 and 252 on the both rail holders 211 and 212 because the user may apply stronger force either on the right side or on the left side.

Third Embodiment

Figure 12:
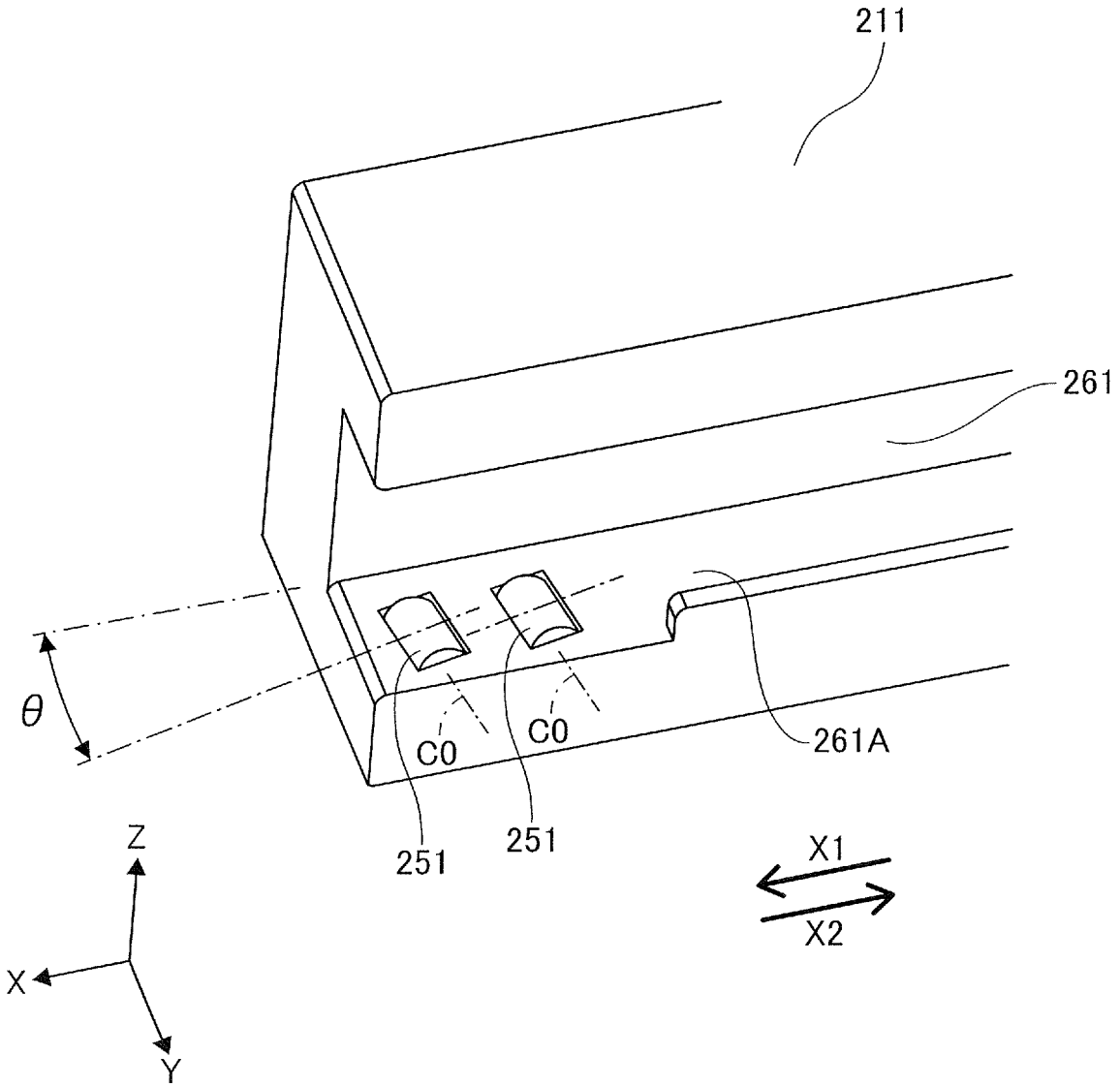
FIG. 12 is a perspective view illustrating a downstream end of a rail holder in a draw-out direction, which is provided in an image forming apparatus of a third embodiment.

Next, an image forming apparatus of a third embodiment will be described. FIG. 12 is a perspective view illustrating a downstream end in the draw-out direction X1 of a rail holder 211, which is provided in the image forming apparatus of the third embodiment. In the third embodiment, a plurality of rail rollers 251, each of which is still another example of a rotator, is arrayed in the rail holder 211 in parallel while leaving a space in the draw-out direction X1 as illustrated in FIG. 12. Because the configuration of the third embodiment other than that is substantially the same with that of the first embodiment, a description thereof will be omitted here. It is noted that in the third embodiment, similarly to the first embodiment as shown in FIG. 4, it will be mainly explained a case where operating force in the draw-out direction X1 is applied to the grip portion 352 on the right side with respect to the reference plane C1. Still further, similarly to the first embodiment, in a case where one side in the width direction Y with respect to the reference plane C1 is referred to as the left side, the other side is the right side. In a case where one side in the width direction Y with respect to the reference plane C1 is referred to as the right side, the other side is the left side.

In the third embodiment, the plurality of rail rollers 251 are rotatably supported by the rail holder 211 as illustrated in FIG. 12, and each abuts with the lower surface of the extension rail 401 (see FIG. 2). Accordingly, the extension rail 401 is supported to be slidable in the mounting/draw-out directions X by the plurality of rail rollers 251. Thereby, pressure acting on one rail roller 251 in drawing the extension rail 401 in the draw-out direction X1 is reduced, and the extension rail 401 is more smoothly slid in the mounting/draw-out directions X.

Each rail roller 251 rotates so as to push the extension rail 401 toward the middle part of the mounting portion 103 (i.e., in a direction approaching the reference plane C1 in FIG. 4) when the extension rail 401 is slid in the draw-out direction X1. More specifically, each rail roller 251 is disposed such that the rotation axis C0 thereof intersects with an imaginary line extending in the width direction Y within a horizontal plane extending in the width direction Y and the mounting/draw-out directions X. In other words, the rotation axes C0 are inclined by an angle θ with respect to the width direction Y such that each rotation axis C0 is located more upstream in the draw-out direction X1 as being closer to the middle position of the sheet cassette 102 in the width direction Y. That is, as illustrated in FIG. 12, orientations of the rail rollers 251 are parallel with each other and are inclined by the angle θ with respect to the mounting/draw-out directions X of the sheet cassette 102. Here, 'an orientation of the rail roller 251' refers to a direction, which is orthogonal to the rotation axis C0 of the rail roller 251 within the horizontal plane extending in the width direction Y and the mounting/draw-out directions X, and in which the extension rail 401 is urged in moving in the mounting/draw-out directions X.

Each rail roller 251 applies a force to a contact part of the extension rail 401 toward the middle position (i.e., to the inner side) in the width direction Y of the mounting portion 103 by rotating when the extension rail 401 slides in the draw-out direction X1. Because the sheet cassette 102 is located on a middle part (i.e., an inner part) of the mounting portion 103 in the width direction Y, the extension rail 401 is pressed against the sheet cassette 102. This arrangement makes it possible to effectively prevent the extension rail 401 from being inclined as illustrated in FIG. 15 in drawing out the sheet cassette 102.

The angle θ is set within a range from 1 degree to 20 degrees. By setting the angle θ to be 1 degree or more (more preferably, 5 degrees or more), the force in the width direction Y applied to the extension rail 401 when the extension rail 401 slides in the draw-out direction X1 becomes large so that the inclination of the extension rail 401 can be effectively restricted. In the same time, by setting the angle θ to be 20 degrees or less (more preferably, 10 degrees or less), increase of resistance for moving the extension rail 401 in the draw-out direction X1 or the mounting direction X2 caused by the inclination of the rail roller 251 is kept low, so that the operability of the sheet cassette 102 is assured.

Still further, the plurality of rail rollers 251 abuts together with the lower surface of the extension rail 401 in the third embodiment similarly to the second embodiment. Accordingly, this arrangement makes it possible to draw out the sheet cassette 102 smoothly in the draw-out direction X1 while more effectively suppressing inclination of the extension rail 401 (and inclination of the sheet cassette 102) as compared to the first embodiment. Still further, because the plurality of rail rollers 251 is disposed adjacent with each other, a load applied to each rail roller 251 is reduced, thus improving durability of the rail roller 251.

In the comparative example as illustrated in FIG. 15, for instance, when the grip portion 352 on the right side with respect to the reference plane C1 is pulled in the draw-out direction X1, the left extension rail 401 on the opposite side may be inclined. According to the third embodiment, in contrast, the plurality of rail rollers 251 on the left side restrict the extension rail 401 from deflecting in the width direction Y and can effectively prevent the extension rail 401 from inclining. Thereby, it becomes possible to slide the extension rail 401 and the sheet cassette 102 straightly in the draw-out direction X1, improving operability of the sheet cassette 102.

Still further, the front side plate 303 is provided with the left grip portion 351 (see FIG. 4) in the same manner with the first embodiment. Accordingly, a plurality of rail rollers on the right side is disposed on the right rail holder 212 (see FIG. 3) at positions symmetrical to the plurality of rail rollers 251 with the reference plane C1 as a plane of symmetry.

It is noted that the third embodiment described above includes the pluralities of rail rollers 251 and 252 are arrayed on the rail holders 211 and 212 similarly to the second embodiment, each rail holder may be provided with only one rail roller like the first embodiment.

Still further, as similar to the first embodiment, in a case where the grip portion 351 on the left side is omitted and only the grip portion 352 on the right side is provided in the front side plate 303, at least one of the rail rollers 251 is disposed on the rail holder 211 on the left side and the right rail rollers 252 may be omitted. In the same manner, in a case where the right grip portion 352 is omitted and only the left grip portion 351 is provided in the front side plate 303, at least one of the rail rollers 252 is disposed on the left right rail holder 212 and the left rail rollers 251 may be omitted. It is preferable to dispose the rail rollers 251 and 252 in the both rail holders 211 and 212 in that the user can operate any part of the front side plate 303. In a case where the grip portion is provided on the reference plane C1, it is preferable to dispose one each or a plurality of rail rollers 251 and 252 on the both rail holders 211 and 212 because the user may apply stronger force either on the right side or on the left side.

Fourth Embodiment

Figure 13A:
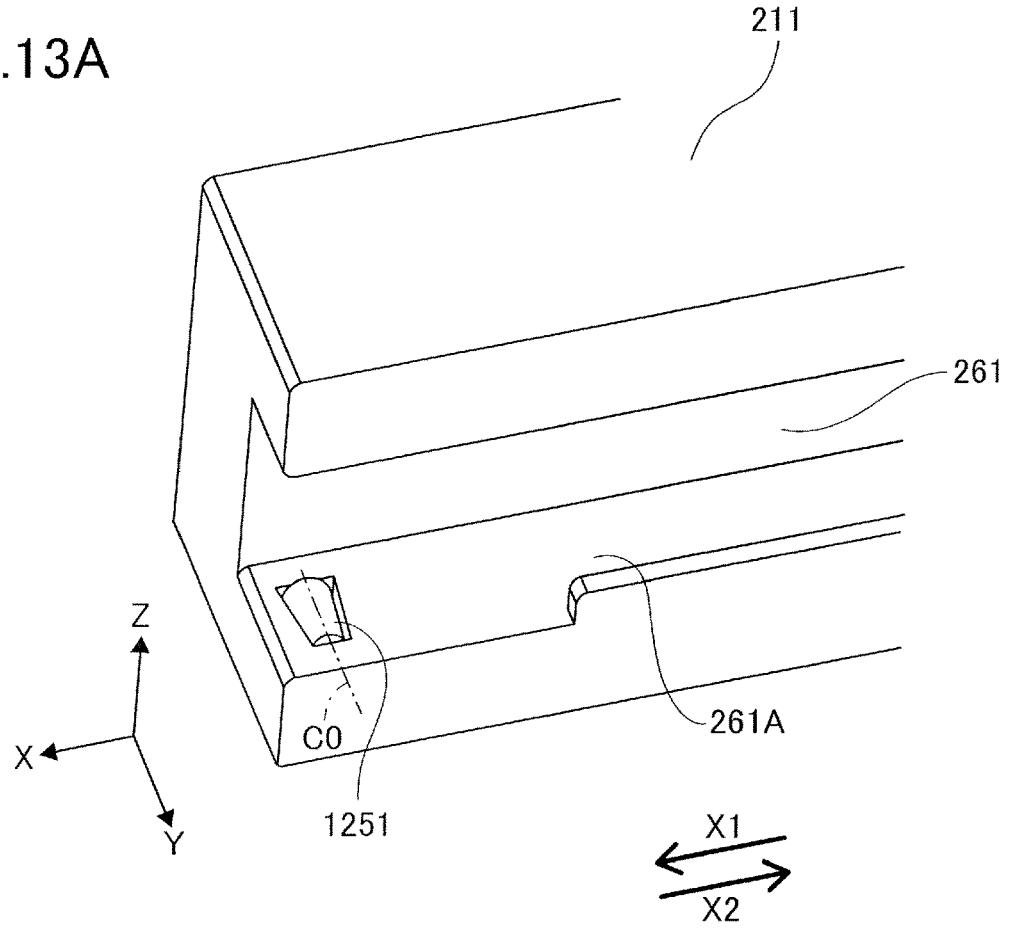
FIG. 13A is a perspective view illustrating a downstream end of a rail holder in a draw-out direction, which is provided in an image forming apparatus of a fourth embodiment.
Figure 13B:
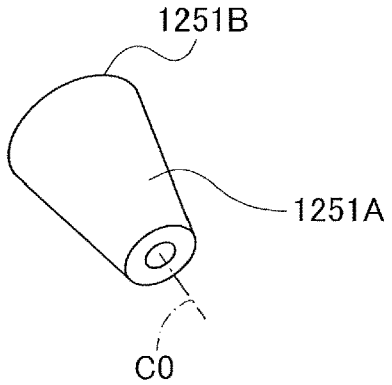
FIG. 13B is a perspective view illustrating a roller body of a rail roller.
Figure 13C:
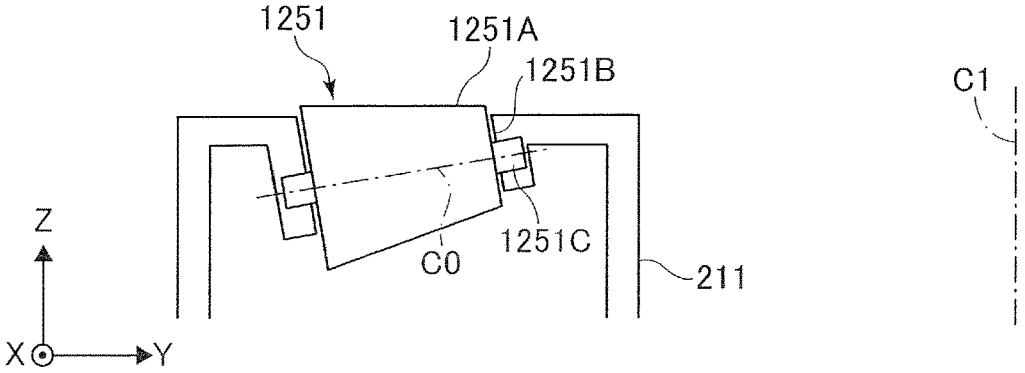
FIG. 13C illustrates a supporting structure of the rail roller viewed in the mounting direction.

Next, an image forming apparatus of a fourth embodiment will be described. FIG. 13A is a perspective view illustrating a downstream end in the draw-out direction X1 of a rail holder 211, which is provided in the image forming apparatus of the fourth embodiment, FIG. 13B is a perspective view illustrating a roller body 1251B of a rail roller 1251 and FIG. 13C illustrates a supporting structure of the rail roller 1251 viewed in the mounting direction X.

In the fourth embodiment, a structure of a rotator is different from that of the first embodiment. As illustrated in FIG. 13A, the rail roller 1251, which is still another example of a rotator, is rotatably disposed on the rail holder 211. Because the configuration other than that is the same with that of the first embodiment, an explanation thereof will be omitted here. It is noted that similarly to the first embodiment as shown in FIG. 4, it will be mainly explained such a case where operating force in the draw-out direction X1 is applied to the grip portion 352.

The rail roller 1251 rotates so as to push the extension rail 401 toward the middle position in the width direction Y of the mounting portion 103 (i.e., toward the reference plane C1) when the extension rail 401 slides in the draw-out direction X1. More specifically, the rail roller 1251 is formed into a shape tapered toward the middle position in the width direction Y of the mounting portion 103.

The rail roller 1251 will be described in more detail. The rail roller 1251 includes the roller body 1251B having a truncated conical peripheral surface 1251A as illustrated in FIG. 13B and a shaft 1251C integrated with the roller body 1251B as illustrated in FIG. 13C. Both ends of the shaft 1251C are supported by the rail holder 211 through bearings. Thereby, the roller body 1251B rotates in a body with the shaft 1251C centering on the rotation axis C0. It is noted that the configuration of the rail roller 1251 is not limited to the above configuration, and a truncated conical roller may be loosely fitted on a shaft that is formed in a body with the rail holder 211. In that case, the shaft does not rotate, and only the truncated conical roller supported by the shaft rotates.

As illustrated in FIG. 13C, the rail roller 1251 is disposed such that the rotation axis C0 is inclined with respect to a horizontal direction so that a part (i.e., an upper part) of the rail roller 1251 that is in contact with the extension rail 401 is laid horizontally. Thereby, the peripheral surface 1251A of the rail roller 1251 is in line-contact with the extension rail 401 on a line extending in the width direction Y. It is noted that a direction in which the rotation axis C0 extends is in parallel with the width direction Y when viewed in the vertical direction Z. Because the rail roller 1251 is formed into the truncated conical shape, an outer diameter thereof differs according to positions in the direction of the rotation axis C0. That is, the farther from the reference plane C1 in the width direction Y, the longer a circumferential length of the peripheral surface 1251A of the rail roller 1251 is. In other words, the outer diameter of the rail roller 1251 gets smaller as being closer to the middle position of the sheet cassette 102. It is noted that a plurality of rail rollers including the illustrated roller 1251 may be arrayed on a neighborhood with their rotation axes C0 putted in parallel similarly to the second embodiment.

Similarly to the first embodiment, the cassette hook 341 provided in the sheet cassette 102 engages with the rail hook 441 provided on the extension rail 401 when the sheet cassette 102 is drawn out of the apparatus body 101 as illustrated in FIG. 5B. When the sheet cassette 102 is drawn out further, the extension rail 401 is drawn out together with the sheet cassette 102 in the draw-out direction X1 while stretching the storage spring 501.

The rail roller 1251 is rotatably supported by the rail holder 211 as illustrated in FIG. 13A and is in contact with the lower surface of the extension rail 401 (see FIG. 2). Accordingly, the rail roller 1251 supports the extension rail 401 to be slidable in the mounting/draw-out directions X. Thereby, the extension rail 401 slides smoothly in the mounting/draw-out directions X.

Here, the rail roller 1251 is configured such that the farther from the reference plane C1, the longer the circumferential length of the peripheral surface 1251A of the rail roller 1251. Due to that, a delivering amount of the extension rail 401 when the rail roller 1251 rotates once is longer at a part of the peripheral surface 1251A farthest from the reference plane C1 than a part closest to the reference plane C1 of the peripheral surface 1251A. As a result, the extension rail 401 is applied with force that pushes the rail toward the reference plane C1 (i.e., toward the middle position of the mounting portion 103 in width direction Y). Because the sheet cassette 102 is located on the inner side in the width direction Y of the mounting portion 103, the extension rail 401 is effectively prevented from inclining. As a result, it is possible to prevent the sheet cassette 102 from inclining, improving operability of the sheet cassette 102.

It is noted that similarly to the first embodiment, the front side plate 303 is also provided with the left grip portion 351 (see FIG. 4) in the fourth embodiment. Accordingly, a rail roller not illustrated and having a plane-symmetrical shape with the rail roller 1251 is disposed on the right rail holder 212 (see FIG. 3) at a position symmetrical to the rail roller 1251 with the reference plane C1 as a plane of symmetry.

It is noted that, as similar to the first embodiment, in a case where the grip portion 351 on the left side is omitted and only the grip portion 352 on the right side is provided in the front side plate 303, the rail roller 1251 is disposed at least on the rail holder 211 on the left side. In this case, the rail roller may be omitted in the rail holder 212 on the right side. In the same manner, in a case where the right grip portion 352 is omitted and only the left grip portion 351 is provided in the front side plate 303, the rail roller 252 is disposed at least on the right rail holder 212 and the left rail roller 1251 may be omitted. It is preferable to dispose the rail rollers on the both rail holders 211 and 212 in that the user can operate any part of the front side plate 303. In a case where the grip portion is provided on the reference plane C1, it is preferable to dispose the rail rollers on the both rail holders 211 and 212 because the user may apply stronger force either on the right side or on the left side.

Other Embodiments

It is noted that the present disclosure is not limited to the embodiments described above and may be modified variously within the scope of the technical idea of the present disclosure. Still further, the advantages described in the embodiments above are no more than the most exemplary preferable advantages brought about by the present disclosure and thus advantages of the present disclosure are not limited to those described in the embodiments.

While the user is supposed to operate the grip portion 351 or 352 provided on the right or left end of the front side plate 303 in the embodiments described above, the configuration of the present disclosure is not limited to that. The grip portion may be provided at any position of the front side plate, and the rail roller (or rollers) may be disposed on either rail holder depending on to the position of the grip portion. For instance, in a case where the grip portion is provided between the reference plane C1 and the end of the front side plate, the rail roller(s) are disposed at least on a side opposite from the side where the grip portion is provided with respect to the reference plane C1. Still further, in a case where the sheet cassette 102 is configured such that the sheet cassette 102 has no grip portion or the grip portion extends over the entire part in the width direction Y of the front side plate 303, the rail roller(s) may be arbitrary disposed regardless whether the user operates the sheet cassette 102 by one hand or by both hands, as long as similar functions and similar advantages with the embodiments above are brought about.

Still further, although the rail rollers in the embodiments above are disposed on the rail holder, which is one example of the rail supporting portion, to be rotatable in contact with the roller, the configuration is not limited to that and a reversed arrangement may be adopted. That is, a roller to be in contact with a rail holder may be rotatably disposed on a rail.

Still further, while the sheet stacking apparatus provided in the image forming apparatus has been described in the embodiments described above, the present disclosure is not limited to such case. For instance, the present disclosure is applicable also to a sheet stacking apparatus provided in a sheet feeding apparatus such as a paper deck unit connected to the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-174342, filed on Sep. 11, 2017, which is hereby incorporated by reference herein in its entirety.

What is claimed is:

1. A sheet stacking apparatus comprising:

a mounting portion;

a sheet stacking portion on which sheets are stacked and which is configured to be mounted into and drawn out of the mounting portion, wherein the sheet stacking portion is provided with a panel disposed on a downstream side of the sheet stacking portion in a draw-out direction and extending in a width direction orthogonal to the draw-out direction, the panel comprising a grip portion by which the sheet stacking portion can be drawn out in the draw-out direction;

a rail supporting portion provided in the mounting portion;

a rail supported to be slidable in the draw-out direction by the rail supporting portion, wherein the sheet stacking portion is supported by the rail and slidable in the draw-out direction with respect to the rail; and a rotatable rotator provided on either the rail supporting portion or the rail and disposed in contact with the other of the rail supporting portion and the rail, wherein the rail, the rail supporting portion, and the rotator are disposed on one side in the width direction with respect to a middle position in the width direction of the sheet stacking portion, and the grip portion is disposed on the other side in the width direction with respect to the middle position, wherein the rail supporting portion comprises a hollow portion open toward the middle position in the width direction and extending in the draw-out direction, wherein the rail is supported in the hollow portion, and wherein the sheet stacking portion comprises a protruded portion that (a) is provided on a side surface of the sheet stacking portion in the width direction, (b) extends in the draw-out direction, and (c) is engaged with the rail.

2. The sheet stacking apparatus according to claim 1, wherein the grip portion is provided on an end portion of the panel in the width direction.

3. The sheet stacking apparatus according to claim 1, further comprising:

a second grip portion provided in the panel and disposed on a side opposite in the width direction from the grip portion provided as a first grip portion;

a second rail supporting portion provided in the mounting portion and disposed on a side opposite in the width direction from the rail supporting portion provided as a first rail supporting portion;

a second rail supported to be slidable in the draw-out direction by the second rail supporting portion and disposed on a side opposite in the width direction from the rail provided as a first rail, wherein the sheet stacking portion is supported by the first and second rails and slidable in the draw-out direction with respect to the first and second rails; and a rotatable second rotator provided on either the second rail supporting portion or the second rail and disposed in contact with the other of the second rail supporting portion and the second rail.

4. The sheet stacking apparatus according to claim 1, wherein the rotator is a cylindrical roller configured to rotate on a rotation axis extending in the width direction.

5. The sheet stacking apparatus according to claim 1, wherein the rotator is configured to rotate such that the rail is urged toward the middle position in the width direction while the rail slides in the draw-out direction.

6. The sheet stacking apparatus according to claim 5, wherein the rotator is a cylindrical roller that is configured to rotate on a rotation axis extending in a direction intersecting with the width direction.

7. The sheet stacking apparatus according to claim 6, wherein the rotation axis of the rotator is inclined with respect to an imaginary line extending in the width direction by an angle within a range from 1 degree to 20 degrees such that the rotation axis is located more upstream in the draw-out direction as the rotation axis extends more closely to the middle position in the width direction.

8. The sheet stacking apparatus according to claim 5, wherein the rotator is a roller of which an outer diameter gets smaller as being closer to the middle position in the width direction.

9. The sheet stacking apparatus according to claim 1, wherein the rotator is one of a plurality of rotators provided on either the rail supporting portion or the rail and arranged in parallel leaving a space in the draw-out direction between each neighboring rotators among the plurality of rotators.

10. The sheet stacking apparatus according to claim 1, wherein the rotator is provided on the rail supporting portion.

11. The sheet stacking apparatus according to claim 10, wherein the rotator is provided on a downstream side of the rail supporting portion in the draw-out direction.

12. The sheet stacking apparatus according to claim 1, further comprising:

an elastic member provided between the rail and the mounting portion so as to urge the rail in a mounting direction opposite from the draw-out direction; and a first engage portion provided in the rail; and a second engage portion provided in the sheet stacking portion and engageable with the first engage portion, wherein in a case where the sheet stacking portion is moved in the draw-out direction, the first engage portion engages with the second engage portion such that the rail is moved in the draw-out direction together with the sheet stacking portion while resisting against elastic force of the elastic member, and wherein in a case where the sheet stacking portion is moved in the mounting direction, the rail is moved in the mounting direction in a state where the first engage portion is kept engaged with the second engage portion due to elastic force applied from the elastic member.

13. An image forming apparatus comprising:

the sheet stacking apparatus as set forth in claim 1; and an image forming portion configured to form an image on a sheet fed from the sheet stacking portion of the sheet stacking apparatus.

14. A sheet stacking apparatus comprising:

a mounting portion;

a sheet stacking portion on which sheets are stacked and which is configured to be mounted into and drawn out of the mounting portion;

a rail supporting portion provided in the mounting portion, the rail supporting portion being fixed with respect to the mounting portion, and being disposed on one side in a width direction, orthogonal to a draw-out direction of the sheet stacking portion, with respect to a middle position of the sheet stacking portion in the width direction;

a rail supported to be slidable in the draw-out direction by the rail supporting portion, wherein the sheet stacking portion is supported by the rail and slidable in the draw-out direction with respect to the rail; and a rotatable rotator provided on the rail supporting portion and disposed in contact with the rail, the rotator being configured to rotate such that the rail is urged toward the middle position in the width direction while the rail slides in the draw-out direction, wherein the rotator is supported by the rail supporting portion such that a rotation axis of the rotator is not moved in the draw-out direction while the rail slides in the draw-out direction.

15. The sheet stacking apparatus according to claim 14, wherein the rotator is a cylindrical roller that is configured to rotate on a rotation axis extending in a direction intersecting with the width direction.

16. The sheet stacking apparatus according to claim 15, wherein the rotation axis of the rotator is inclined with respect to an imaginary line extending in the width direction by an angle within a range from 1 degree to 20 degrees such that the rotation axis is located more upstream in the draw-out direction as the rotation axis extends more closely to the middle position in the width direction.

17. The sheet stacking apparatus according to claim 14, wherein the rotator is a roller of which an outer diameter gets smaller as being closer to the middle position in the width direction.

18. The sheet stacking apparatus according to claim 14, further comprising:

a second rail supporting portion provided in the mounting portion, the second rail supporting portion being fixed with respect to the mounting portion, and being disposed on a side opposite in the width direction from the rail supporting portion provided as a first rail supporting portion;

a second rail supported to be slidable in the draw-out direction by the second rail supporting portion and disposed on a side opposite in the width direction from the rail provided as a first rail, wherein the sheet stacking portion is supported by the first and second rails and slidable in the draw-out direction with respect to the first and second rails; and a rotatable second rotator provided on either the second rail supporting portion and disposed in contact with the second rail, the second rotator being configured to rotate such that the second rail is urged toward the middle position in the width direction as the second rail slides in the draw-out direction, wherein the second rotator is supported by the second rail supporting portion such that a rotation axis of the second rotator is not moved in the draw-out direction while the second rail slides in the draw-out direction.

19. An image forming apparatus comprising:

the sheet stacking apparatus as set forth in claim 14; and an image forming portion configured to form an image on a sheet fed from the sheet stacking portion of the sheet stacking apparatus.

* * * * *